US012253277B2

(12) United States Patent
Yoshimi et al.

(10) Patent No.: US 12,253,277 B2
(45) Date of Patent: Mar. 18, 2025

(54) AIR CONDITIONER

(71) Applicant: DAIKIN INDUSTRIES, LTD., Osaka (JP)

(72) Inventors: Atsushi Yoshimi, Osaka (JP); Takuro Yamada, Osaka (JP); Eiji Kumakura, Osaka (JP); Ikuhiro Iwata, Osaka (JP); Takeru Miyazaki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 278 days.

(21) Appl. No.: 17/704,250

(22) Filed: Mar. 25, 2022

(65) Prior Publication Data

US 2022/0214056 A1 Jul. 7, 2022

Related U.S. Application Data

(63) Continuation of application No. PCT/JP2020/036083, filed on Sep. 24, 2020.

(30) Foreign Application Priority Data

Sep. 30, 2019 (JP) ..... 2019-180831

(51) Int. Cl.
*F24F 3/06* (2006.01)
*F25B 25/00* (2006.01)
*F25B 29/00* (2006.01)

(52) U.S. Cl.
CPC ..... *F24F 3/06* (2013.01); *F25B 25/005* (2013.01); *F25B 29/003* (2013.01); (Continued)

(58) Field of Classification Search
CPC ..... F24F 3/06; F24F 2203/021; F24F 3/065; F24F 11/65; F24F 11/86; F24F 11/67; (Continued)

(56) References Cited

U.S. PATENT DOCUMENTS

2011/0005270 A1 1/2011 Yoshimi et al.
2012/0260685 A1 10/2012 Honda
2014/0102131 A1* 4/2014 Okamoto ..... F25B 1/10 62/510

FOREIGN PATENT DOCUMENTS

JP 2010-096360 A 4/2010
JP 2010-156493 A 7/2010
(Continued)

OTHER PUBLICATIONS

International Search Report issued in corresponding International Application No. PCT/JP2020/036083 mailed Dec. 1, 2020 (5 pages).
(Continued)

*Primary Examiner* — Kun Kai Ma
(74) *Attorney, Agent, or Firm* — Osha Bergman Watanabe & Burton LLP

(57) ABSTRACT

An air conditioner includes: use-side units that are each switchable between a cooling operation and a heating operation; and a heat-source-side unit including a compressor, a discharge pipe through which a refrigerant discharged from the compressor flows, a first main heat-source-side flow path and a second main heat-source-side flow path that branch off from the discharge pipe, a first heat-source-side heat exchanger, a second heat-source-side heat exchanger, a first economizer heat exchanger, and a second economizer heat exchanger. The first heat-source-side heat exchanger is connected to the first economizer heat exchanger in series in the first main heat-source-side flow path. The second heat-source-side heat exchanger is connected to the second economizer heat exchanger in series in the second main heat-source-side flow path.

5 Claims, 11 Drawing Sheets

(52) U.S. Cl.
CPC ..... *F24F 2203/021* (2013.01); *F25B 2313/02743* (2013.01); *F25B 2400/06* (2013.01); *F25B 2600/02* (2013.01); *F25B 2600/13* (2013.01)

(58) Field of Classification Search
CPC ..... F25B 25/005; F25B 29/003; F25B 2313/02743; F25B 2400/06; F25B 2313/0233; F25B 2400/13; F25B 1/10; F25B 5/02; F25B 6/02; F25B 13/00; F25B 41/24; F25B 39/00
See application file for complete search history.

(56) References Cited

FOREIGN PATENT DOCUMENTS

| | | | | | |
|---|---|---|---|---|---|
| JP | 5239824 | B2 | | 7/2013 | |
| JP | 6331768 | B2 | | 5/2018 | |
| JP | 2019113258 | A | * | 7/2019 | |
| WO | WO-2007086445 | A1 | * | 8/2007 | ..... F25B 45/00 |
| WO | WO-2008059737 | A1 | * | 5/2008 | ..... F25B 9/008 |
| WO | WO-2011080802 | A1 | * | 7/2011 | ..... F24F 3/06 |
| WO | WO-2011080804 | A1 | * | 7/2011 | ..... F24F 3/06 |
| WO | WO-2019049746 | A1 | * | 3/2019 | ..... F25B 1/00 |
| WO | WO-2020039707 | A1 | * | 2/2020 | |

OTHER PUBLICATIONS

International Preliminary Report on Patentability issued in corresponding International Application No. PCT/JP2020/036083 mailed Apr. 14, 2022 (6 pages).
Extended European search report issued in corresponding European Patent Application No. 20872043.3 dated Sep. 28, 2022 (8 pages).

* cited by examiner

AIR CONDITIONER

TECHNICAL FIELD

The present disclosure relates to an air conditioner.

BACKGROUND

As disclosed in PTL 1 (Japanese Unexamined Patent Application Publication No. 2010-156493), multi-split air conditioners exist in the art that include plural heat-source-side heat exchangers and plural use-side units and are designed such that whether to perform a cooling operation or a heating operation can be freely selected for each individual use-side unit. One conceivable way to improve the operating efficiency of such an air conditioner is to provide the air conditioner with an economizer heat exchanger.

SUMMARY

An air conditioner according to one or more embodiments includes a plurality of use-side units, and a heat-source-side unit. The heat-source-side unit includes a compressor, a discharge pipe, a first main heat-source-side flow path, a second main heat-source-side flow path, a first heat-source-side heat exchanger, a second heat-source-side heat exchanger, a first economizer heat exchanger, and a second economizer heat exchanger. Each of the use-side units is switchable between a cooling operation and a heating operation. The discharge pipe is a pipe through which a refrigerant discharged from the compressor flows. The first main heat-source-side flow path and the second main heat-source-side flow path branch off from the discharge pipe. The first heat-source-side heat exchanger and the first economizer heat exchanger are connected in series in the first main heat-source-side flow path. The second heat-source-side heat exchanger and the second economizer heat exchanger are connected in series in the second main heat-source-side flow path.

DETAILED DESCRIPTION (1) General Configuration of Air Conditioner

Figure 1:
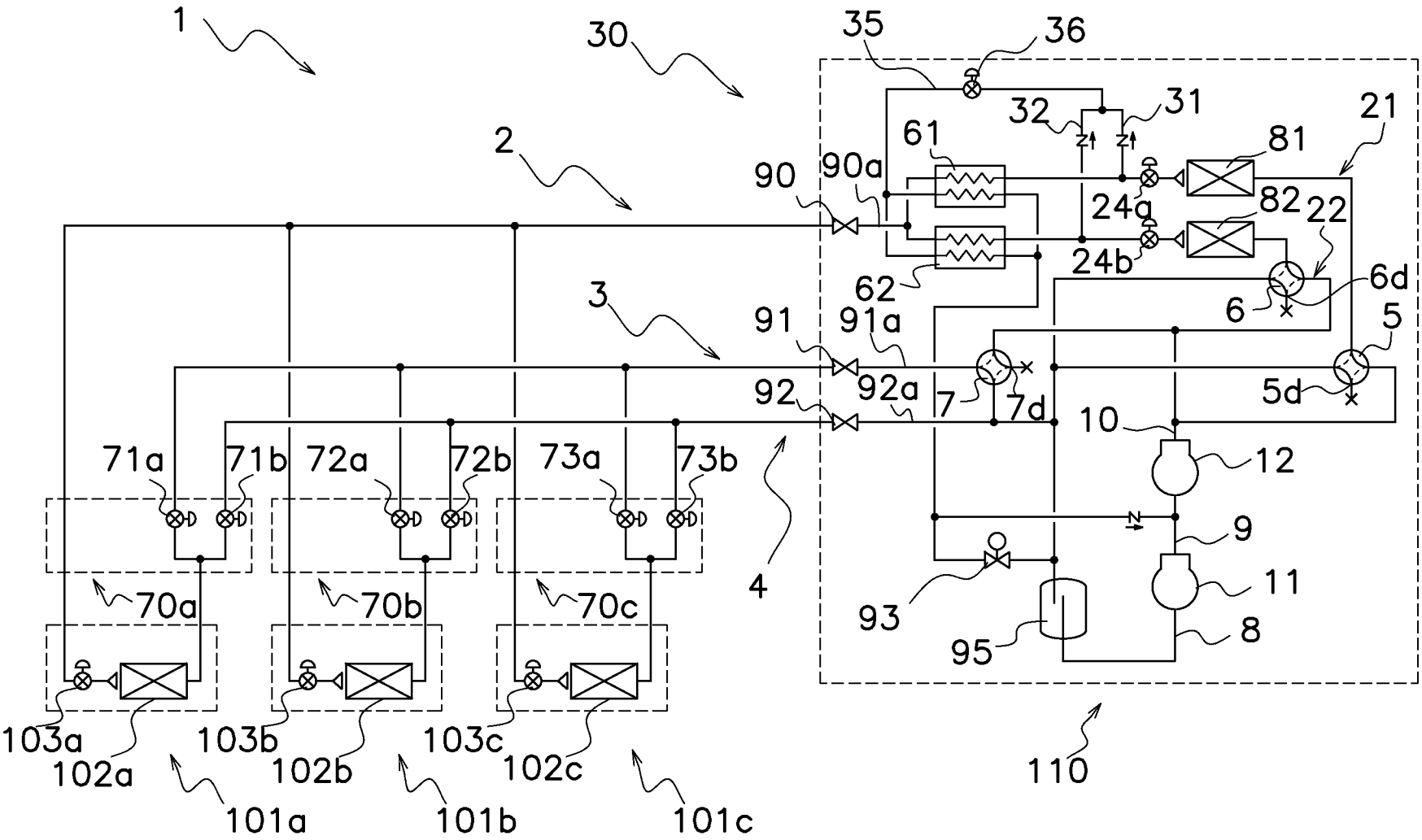
FIG. 1 is a schematic diagram of an air conditioner 1 according to one or more embodiments of the present disclosure.

FIG. 1 is a schematic diagram of an air conditioner 1 according to one or more embodiments of the present disclosure. The air conditioner 1 includes the following components that constitute a refrigerant circuit 30: plural use-side units 101*a*, 101*b*, and 101*c*, a heat-source-side unit 110, a control unit 120, and branch units 70*a*, 70*b*, and 70*c*. The air conditioner 1 is designed such that whether to perform a cooling operation (first operation) or a heating operation (second operation) can be freely selected for each individual use-side unit. The air conditioner 1 performs a two-stage compression refrigeration cycle by use of a refrigerant that works in the supercritical region (which in this example is a CO2 refrigerant or a CO2 refrigerant mixture that comprises a CO2 refrigerant).

(2) Detailed Configuration (2-1) Use-Side Units

The use-side units 101*a*, 101*b*, and 101*c* are installed on the indoor ceiling of a building or other structure such as by being embedded in or suspended from the ceiling. Alternatively, the use-side units 101*a*, 101*b*, and 101*c* are installed on the indoor wall such as by being mounted on the wall. The use-side units 101*a*, 101*b*, and 101*c* are connected to the heat-source-side unit 110 via the following components: a liquid-refrigerant connection pipe 2, a high/low pressure gas-refrigerant connection pipe 3, a low pressure gas-refrigerant connection pipe 4, the branch units 70*a*, 70*b*, and 70*c*, a first shutoff valve 90, a second shutoff valve 91, and a third shutoff valve 92. The use-side units 101*a*, 101*b*, and 101*c* constitute a part of the refrigerant circuit 30.

The first use-side unit 101*a* includes a first use-side heat exchanger 102*a*, and a first use-side expansion mechanism 103*a*. The second use-side unit 101*b* includes a second use-side heat exchanger 102*b*, and a second use-side expansion mechanism 103*b*. The third use-side unit 101*c* includes a third use-side heat exchanger 102*c*, and a third use-side expansion mechanism 103*c*. The use-side heat exchangers 102*a*, 102*b*, and 102*c* are heat exchangers that exchange heat between the refrigerant and indoor air to thereby handle an indoor air-conditioning load (thermal load). The use-side expansion mechanisms 103*a*, 103*b*, and 103*c* are mechanisms for causing the refrigerant to expand. The use-side expansion mechanisms 103*a*, 103*b*, and 103*c* are each implemented by an electric expansion valve.

The use-side units 101*a*, 101*b*, and 101*c* each include a use-side control unit 104 that controls operations of individual components constituting the use-side units 101*a*, 101*b*, and 101*c*. The use-side control unit 104 includes a microcomputer, and various electrical components. The microcomputer includes a central processing unit (CPU), a memory, and other components provided for controlling the use-side units 101*a*, 101*b*, and 101*c*. The CPU reads a program stored in the memory or other storage device, and performs a predetermined computational process in accordance with the program. Further, the CPU is capable of performing an operation in accordance with the program, such as writing the results of computation into the memory or reading information stored in the memory. The use-side control unit 104 is capable of exchanging a control signal or other information with the heat-source-side unit 110 via a communications line. The use-side control unit 104 is also capable of receiving a signal related to activation or deactivation of the air conditioner 1, a signal related to various settings, or other information transmitted from a remote control (not illustrated) used for operating the use-side units 101*a*, 101*b*, and 101*c*.

Although the following description of the embodiments is directed to the air conditioner 1 including three use-side units 101*a*, 101*b*, and 101*c*, the present disclosure is also applicable to an air conditioner including more than three use-side units.

(2-2) Heat-Source-Side Unit

The heat-source-side unit 110 is installed on the rooftop of a building or other structure, or around a building or other structure. The heat-source-side unit 110 is connected to the use-side units 101*a*, 101*b*, and 101*c*, and constitutes a part of the refrigerant circuit 30.

The heat-source-side unit 110 mainly includes the following components: a first compressor 11, a second compressor 12, a discharge pipe 10, a first main heat-source-side flow path 21, a second main heat-source-side flow path 22, a first heat-source-side heat exchanger 81, a second heat-source-side heat exchanger 82, a first economizer heat exchanger 61, a second economizer heat exchanger 62, a first economizer pipe 31, a second economizer pipe 32, a fourth shutoff valve 93, and an accumulator 95.

The heat-source-side unit 110 also includes a heat-source-side control unit 111 that controls operations of individual components constituting the heat-source-side unit 110. The heat-source-side control unit 111 includes a microcomputer, and various electrical components. The microcomputer includes a central processing unit (CPU), a memory, and other components provided for controlling the heat-source-side unit 110. The CPU reads a program stored in the memory or other storage device, and performs a predetermined computational process in accordance with the program. Further, the CPU is capable of performing an operation in accordance with the program, such as writing the results of computation into the memory or reading information stored in the memory. The heat-source-side control unit 111 is capable of exchanging a control signal or other information with the use-side control unit 104 of each of the use-side units 101*a*, 101*b*, and 101*c* via a communications line.

(2-2-1) Compressors

The compressors 11 and 12 include the first compressor 11, which is the compressor of the lower stage, and the second compressor 12, which is the compressor of the higher stage.

The compressors 11 and 12 include the first compressor 11, which is a single-stage compressor that compresses low pressure refrigerant in the refrigeration cycle to an intermediate pressure in the refrigeration cycle, and the second compressor 12, which is a single-stage compressor that compresses intermediate-pressure refrigerant in the refrigeration cycle to a high pressure in the refrigeration cycle. Low-pressure refrigerant in the refrigeration cycle is sucked via a suction pipe 8 into the first compressor 11 of the lower stage, and compressed by the first compressor 11 to an intermediate pressure in the refrigeration cycle. After being compressed by the first compressor 11 to an intermediate pressure in the refrigeration cycle, the intermediate-pressure refrigerant in the refrigeration cycle is discharged to an intermediate refrigerant pipe 9 and then sucked into the second compressor 12 of the higher stage. After being sucked into the second compressor 12 of the higher stage, the intermediate-pressure refrigerant in the refrigeration cycle is compressed by the second compressor 12 to a high pressure in the refrigeration cycle before being discharged to the discharge pipe 10.

(2-2-2) Discharge Pipe

The discharge pipe 10 is a pipe to which refrigerant is discharged after being compressed by the second compressor 12 of the higher stage to a high pressure in the refrigeration cycle. As illustrated in FIG. 1, the discharge pipe 10 branches off into the first main heat-source-side flow path 21, the second main heat-source-side flow path 22, and the high/low pressure gas-refrigerant connection pipe 3.

(2-2-3) First Main Heat-Source-Side Flow Path and Second Main Heat-Source-Side Flow Path The first main heat-source-side flow path 21 is a pipe that branches off from the discharge pipe 10 and connects to the liquid-refrigerant connection pipe 2. The first main heat-source-side flow path 21 connects the first heat-source-side heat exchanger 81 and the first economizer heat exchanger 61 in series. The first main heat-source-side flow path 21 branches off to the first economizer pipe 31 at a point between the first heat-source-side heat exchanger 81 and the first economizer heat exchanger 61. The first main heat-source-side flow path 21 is provided with a first heat-source-side expansion mechanism 24*a*.

The second main heat-source-side flow path 22 is a pipe that branches off from the discharge pipe 10 and connects to the liquid-refrigerant connection pipe 2. The second main heat-source-side flow path 22 connects the second heat-source-side heat exchanger 82 and the second economizer heat exchanger 62 in series. The second main heat-source-side flow path 22 branches off to the second economizer pipe 32 at a point between the second heat-source-side heat exchanger 82 and the second economizer heat exchanger 62. The second main heat-source-side flow path 22 is provided with a second heat-source-side expansion mechanism 24*b*.

The first heat-source-side expansion mechanism 24*a* and the second heat-source-side expansion mechanism 24*b* are each implemented by an electric expansion valve in this case.

(2-2-4) First Economizer Pipe and Second Economizer Pipe

The first economizer pipe 31 is a pipe that branches off from the first main heat-source-side flow path 21 at a point between the first heat-source-side heat exchanger 81 and the first economizer heat exchanger 61, and extends toward the compressors 11 and 12.

The second economizer pipe 32 is a pipe that branches off from the second main heat-source-side flow path 22 at a point between the second heat-source-side heat exchanger 82 and the second economizer heat exchanger 62, and extends toward the compressors 11 and 12.

The first economizer pipe 31 and the second economizer pipe 32 have a common part 35.

The common part 35 is a pipe disposed between the location of branching from the first main heat-source-side flow path 21, and the first economizer heat exchanger 61, and between the location of branching from the second main heat-source-side flow path 22, and the second economizer heat exchanger 62. The common part 35 is provided with an expansion mechanism (i.e., expansion valve) 36. The refrigerant passing through the common part 35 is decompressed by the expansion mechanism 36 to an intermediate pressure in the refrigeration cycle.

(2-2-5) First Heat-Source-Side Heat Exchanger and Second Heat-Source-Side Heat Exchanger Each of the first heat-source-side heat exchanger 81 and the second heat-source-side heat exchanger 82 is a heat exchanger that functions as either a radiator or condenser for refrigerant. The liquid side of the first heat-source-side heat exchanger 81, and the liquid side of the second heat-source-side heat exchanger 82 are connected by the first main heat-source-side flow path 21 and the second main heat-source-side flow path 22.

The first heat-source-side heat exchanger 81 is connected in series with the first economizer heat exchanger 61 by the first main heat-source-side flow path 21. The second heat-source-side heat exchanger 82 is connected in series with the second economizer heat exchanger 62 by the second main heat-source-side flow path 22.

(2-2-6) First Economizer Heat Exchanger and Second Economizer Heat Exchanger

The first economizer heat exchanger 61 and the second economizer heat exchanger 62 are double-pipe heat exchangers or plate heat exchangers in this case. After refrigerant rejects heat in the first heat-source-side heat exchanger 81 or the second heat-source-side heat exchanger 82, the refrigerant is subcooled by further rejecting heat in the first economizer heat exchanger 61 or the second economizer heat exchanger 62.

In the first economizer heat exchanger 61, the refrigerant flowing in the first main heat-source-side flow path 21, and the refrigerant flowing in the first economizer pipe 31 exchange heat. The first economizer heat exchanger 61 is connected in series with the first heat-source-side heat exchanger 81 via the first main heat-source-side flow path 21.

In the second economizer heat exchanger 62, the refrigerant flowing in the second main heat-source-side flow path 22, and the refrigerant flowing in the second economizer pipe 32 exchange heat. The second economizer heat exchanger 62 is connected in series with the second heat-source-side heat exchanger 82 via the second main heat-source-side flow path 22.

(2-3) Control Unit 120

The control unit 120 controls the operations of individual devices constituting the air conditioner 1. The air conditioner 1 can be controlled by the control unit 120 to switch between a first operation, a second operation, and a third operation, which will be described later.

Figure 2:
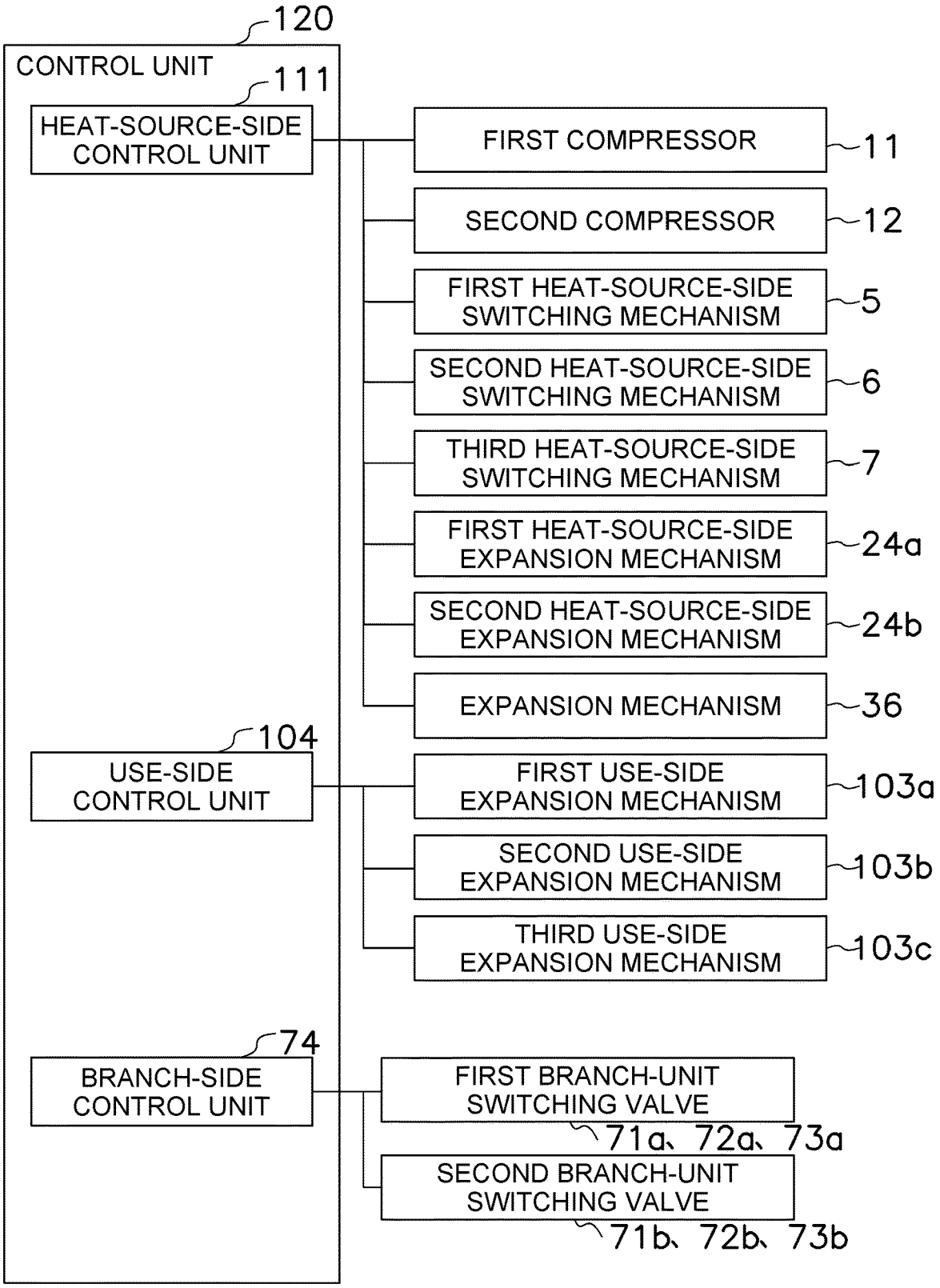
FIG. 2 is a block diagram of a control unit (used interchangeably herein with "controller") of a refrigeration cycle apparatus illustrated in FIG. 1.

The control unit 120 includes the following components coupled to each other via a communications line (see FIG. 2): the use-side control unit 104 mentioned above, the heat-source-side control unit 111 mentioned above, and a branch-side control unit 74 described later.

Exemplary devices constituting the air conditioner 1 and controlled by the control unit 120 include the compressors 11 and 12, a first heat-source-side switching mechanism 5, a second heat-source-side switching mechanism 6, a third heat-source-side switching mechanism 7, the heat-source-side expansion mechanisms 24*a* and 24*b*, the use-side expansion mechanisms 103*a*, 103*b*, and 103*c*, and the branch units 70*a*, 70*b*, and 70*c*.

The first heat-source-side switching mechanism 5, the second heat-source-side switching mechanism 6, and the third heat-source-side switching mechanism 7 are mechanisms for switching the directions of refrigerant flow in the refrigerant circuit 30. More specifically, these switching mechanisms are used to switch between a radiating operation state and an evaporating operation state. In the radiating operation state, the control unit 120 determines to cause the first heat-source-side heat exchanger 81 and the second heat-source-side heat exchanger 82 to function as radiators for refrigerant. In the evaporating operation state, the control unit 120 determines to cause the first heat-source-side heat exchanger 81 and the second heat-source-side heat exchanger 82 to function as evaporators for refrigerant.

The first heat-source-side switching mechanism 5, the second heat-source-side switching mechanism 6, and the third heat-source-side switching mechanism 7 are four-way switching valves in this case. A fourth port 5*d* of the first heat-source-side switching mechanism 5, a fourth port 6*d* of the second heat-source-side switching mechanism 6, and a fourth port 7*d* of the third heat-source-side switching mechanism 7 are closed, and thus the first heat-source-side switching mechanism 5, the second heat-source-side switching mechanism 6, and the third heat-source-side switching mechanism 7 function as three-way valves.

(2-4) Branch Units

The branch units 70*a*, 70*b*, and 70*c* are respectively installed, for example, near the use-side units 101*a*, 101*b*, and 101*c* in an indoor space of a building or other structure. The branch units 70*a*, 70*b*, and 70*c* are respectively interposed between the use-side units 101*a*, 101*b*, and 101*c* and the heat-source-side unit 110 and each constitute a part of the refrigerant circuit 30, together with the liquid-refrigerant connection pipe 2, the high/low pressure gas-refrigerant connection pipe 3, and the low pressure gas-refrigerant connection pipe 4. The branch units 70*a*, 70*b*, and 70*c* are respectively installed for the three use-side units 101*a*, 101*b*, and 101*c* in a one-to-one relationship. Alternatively, plural use-side units that are switched between cooling and heating at the same timing are connected to a single branch unit. The branch units 70*a*, 70*b*, and 70*c* may be respectively incorporated in the use-side units 101*a*, 101*b*, and 101*c*. In this case, the branch units 70*a*, 70*b*, and 70*c* can be respectively regarded as constituting portions of the use-side units 101*a*, 101*b*, and 101*c*.

The branch units 70*a*, 70*b*, and 70*c* each mainly include a first branch path, and a second branch path. The respective first branch paths of the branch units 70*a*, 70*b*, and 70*c* include first branch-unit switching valves 71*a*, 72*a*, and 73*a*, and the respective second branch paths of the branch units 70*a*, 70*b*, and 70*c* include second branch-unit switching valves 71*b*, 72*b*, and 73*b*. The first branch-unit switching valves 71*a*, 72*a*, and 73*a* are electromagnetic valves for switching whether to allow communication between the high/low pressure gas-refrigerant connection pipe 3 and the use-side heat exchangers 102*a*, 102*b*, and 102*c*, respectively. The second branch-unit switching valves 71*b*, 72*b*, and 73*b* are electromagnetic valves for switching whether to allow communication between the low pressure gas-refrigerant connection pipe 4 and the use-side heat exchangers 102*a*, 102*b*, and 102*c*, respectively.

The branch units 70*a*, 70*b*, and 70*c* each include the branch-side control unit 74 that controls operations of individual components constituting the branch units 70*a*, 70*b*, and 70*c*. The branch-side control unit 74 includes a microcomputer, and various electrical components. The microcomputer includes a central processing unit (CPU), a memory, and other components provided for controlling the branch units 70*a*, 70*b*, and 70*c*. The CPU reads a program stored in the memory or other storage device, and performs a predetermined computational process in accordance with the program. Further, the CPU is capable of performing an operation in accordance with the program, such as writing the results of computation into the memory or reading information stored in the memory. The branch-side control unit 74 is capable of exchanging a control signal or other information with the use-side control unit 104 of each of the use-side units 101*a*, 101*b*, and 101*c*.

(3) Operation of Air Conditioner

Reference is now made to how the air conditioner 1 according to one or more embodiments operates. The air conditioner 1 according to one or more embodiments is switched between the first operation, the second operation, and the third operation by the control unit 120 to thereby provide air conditioning.

The first operation is an operational state (cooling only operation) in which only use-side heat exchangers serving as evaporators for refrigerant (use-side units that perform cooling) exist.

The second operation is an operational state (heating only operation) in which only use-side heat exchangers serving as radiators for refrigerant (use-side units that perform heating) exist.

The third operation is an operation in which both a use-side unit that performs cooling and a use-side unit that performs heating exist (cooling and heating simultaneous operation). The third operation includes a third operation A, a third operation B, and a third operation C.

The third operation A is an operational state (cooling main operation) in which although both a use-side heat exchanger serving as an evaporator for refrigerant and a use-side heat exchanger serving as a radiator for refrigerant exist, the load on the evaporation side is greater as a whole.

The third operation B is an operational state (heating main operation) in which although both a use-side heat exchanger serving as a radiator for refrigerant and a use-side heat exchanger serving as an evaporator for refrigerant exist, the load on the radiation side is greater as a whole.

The third operation C is an operational state (cooling and heating balanced operation) in which both a use-side heat exchanger serving as an evaporator for refrigerant and a use-side heat exchanger serving as a radiator for refrigerant exist, and the evaporation load and the radiation load are balanced as a whole.

(3-1) First Operation

Figure 3:
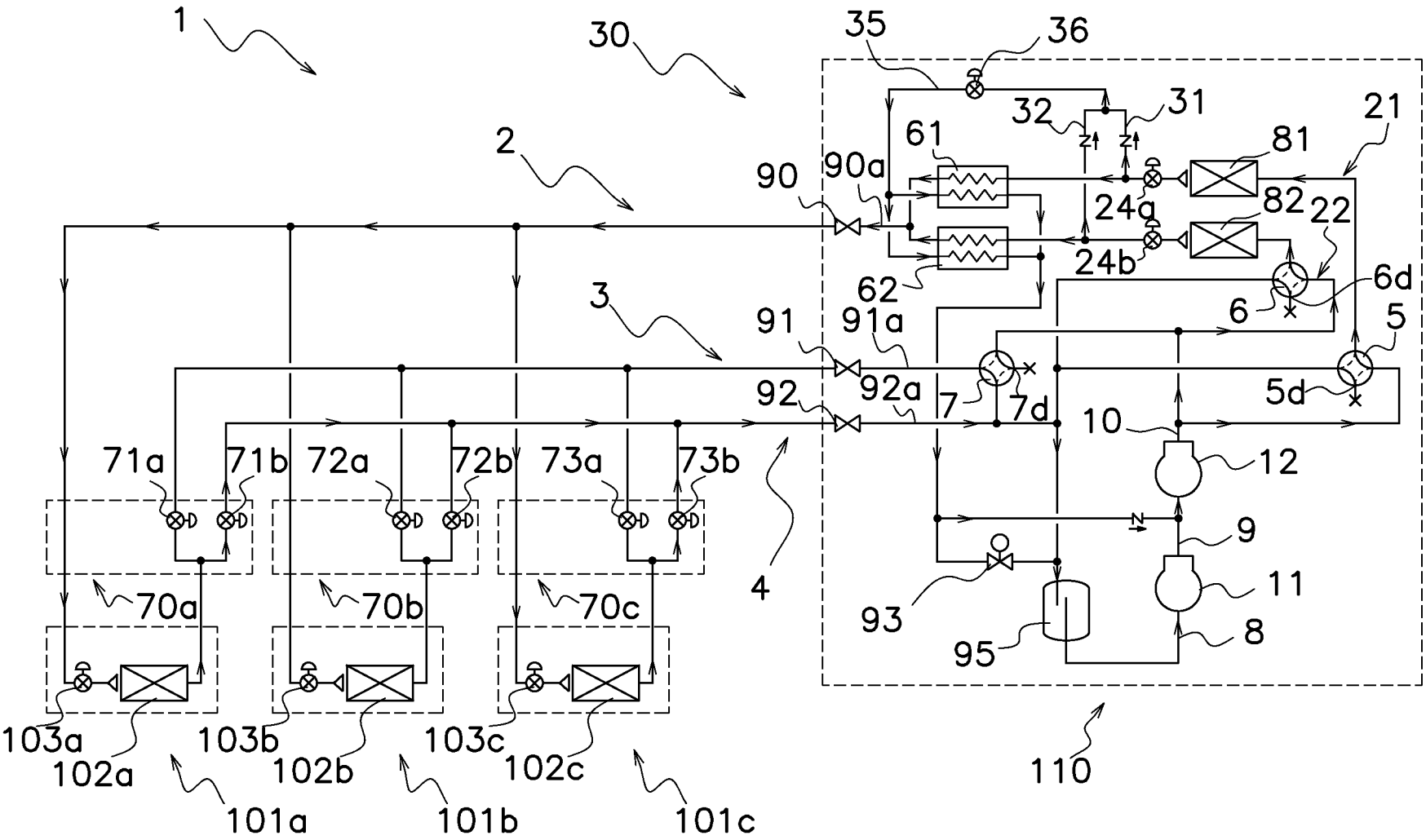
FIG. 3 is a schematic diagram illustrating how the air conditioner 1 performs a first operation.

Reference is now made to how the first operation is performed, by way of an example case where the control unit 120 causes the first use-side heat exchanger 102*a* and the third use-side heat exchanger 102*c* to function as evaporators for refrigerant to perform cooling, and deactivates the second use-side heat exchanger 102*b* (see FIG. 3).

In the first operation, the control unit 120 determines to cause the first heat-source-side heat exchanger 81 and the second heat-source-side heat exchanger 82 to function as radiators for refrigerant. The control unit 120 switches the first heat-source-side switching mechanism 5, the second heat-source-side switching mechanism 6, and the third heat-source-side switching mechanism 7 to a radiating operation state (in which the first heat-source-side switching mechanism 5, the second heat-source-side switching mechanism 6, and the third heat-source-side switching mechanism 7 are in the state shown by solid lines in FIG. 3). The control unit 120 closes the first branch-unit switching valves 71*a*, 72*a*, and 73*a* and the second branch-unit switching valve 72*b*, and opens the second branch-unit switching valves 71*b* and 73*b*.

With the refrigerant circuit 30 in the above-mentioned state (for the flow of refrigerant in this state, see arrows attached to the refrigerant circuit 30 in FIG. 3), low pressure refrigerant in the refrigeration cycle is sucked from the suction pipe 8 into the first compressor 11 of the lower stage. After being sucked into the first compressor 11 of the lower stage, the low pressure refrigerant in the refrigeration cycle is compressed in the first compressor 11 of the lower stage to an intermediate pressure in the refrigeration cycle before being discharged to the intermediate refrigerant pipe 9. After being discharged from the first compressor 11 of the lower stage to the intermediate refrigerant pipe 9, the intermediate-pressure refrigerant in the refrigeration cycle is sucked into the second compressor 12 of the higher stage, and compressed in the second compressor 12 to a high pressure in the refrigeration cycle before being discharged to the discharge pipe 10. At this time, the high pressure refrigerant in the refrigeration cycle discharged from the second compressor 12 of the higher stage has been compressed through the two-stage compression action of the compressors 11 and 12 to a pressure exceeding the critical pressure of the refrigerant. After the high pressure refrigerant in the refrigeration cycle is discharged to the discharge pipe 10 from the second compressor 12 of the higher stage, a part of the high pressure refrigerant flows to the first main heat-source-side flow path 21, and the remainder flows to the second main heat-source-side flow path 22.

The refrigerant that has flown from the discharge pipe 10 to the first main heat-source-side flow path 21 is routed via the first heat-source-side switching mechanism 5 to the first heat-source-side heat exchanger 81. The high pressure refrigerant in the refrigeration cycle routed to the first heat-source-side heat exchanger 81 rejects heat through heat exchange with outdoor air or other medium in the first heat-source-side heat exchanger 81 serving as a radiator for refrigerant. After rejecting heat in the first heat-source-side heat exchanger 81, the high pressure refrigerant in the refrigeration cycle is decompressed in the first heat-source-side expansion mechanism 24*a*. The refrigerant decompressed in the first heat-source-side expansion mechanism 24*a* is routed to the first economizer heat exchanger 61. At this time, a part of the refrigerant decompressed in the first heat-source-side expansion mechanism 24*a* and flowing in the first main heat-source-side flow path 21 branches off to the first economizer pipe 31.

The refrigerant that has been decompressed in the first heat-source-side expansion mechanism 24*a* and has branched off from the first main heat-source-side flow path 21 to the first economizer pipe 31 flows to the common part 35. Upon entering the common part 35, the refrigerant is decompressed by the expansion mechanism 36 of the common part 35 to an intermediate pressure in the refrigeration cycle. After being decompressed by the expansion mechanism 36 of the common part 35 to an intermediate pressure in the refrigeration cycle, the refrigerant branches off from the common part 35 to the first economizer pipe 31 again, and then flows to the first economizer heat exchanger 61. Upon entering the first economizer heat exchanger 61, the intermediate-pressure refrigerant in the refrigeration cycle exchanges heat in the first economizer heat exchanger 61 with the refrigerant flowing in the first main heat-source-side flow path 21. After exchanging heat in the first economizer heat exchanger 61 with the refrigerant flowing in the first main heat-source-side flow path 21, the intermediate-pressure refrigerant in the refrigeration cycle is routed via the intermediate refrigerant pipe 9 to the second compressor 12 of the higher stage.

The refrigerant flowing in the first main heat-source-side flow path 21 that has been decompressed in the first heat-source-side expansion mechanism 24*a* and routed to the first economizer heat exchanger 61 is cooled in the first economizer heat exchanger 61 through heat exchange with the refrigerant flowing in the first economizer pipe 31. After being cooled in the first economizer heat exchanger 61, the refrigerant flowing in the first main heat-source-side flow path 21 is routed via the liquid-refrigerant connection pipe 2 to the use-side expansion mechanisms 103*a* and 103*c*.

The refrigerant that has flown from the discharge pipe 10 to the second main heat-source-side flow path 22 is routed via the second heat-source-side switching mechanism 6 to the second heat-source-side heat exchanger 82. The high pressure refrigerant in the refrigeration cycle routed to the second heat-source-side heat exchanger 82 rejects heat through heat exchange with outdoor air or other medium in the second heat-source-side heat exchanger 82 serving as a radiator for refrigerant. After rejecting heat in the second heat-source-side heat exchanger 82, the high pressure refrigerant in the refrigeration cycle is decompressed in the second heat-source-side expansion mechanism 24*b*. The refrigerant decompressed in the second heat-source-side expansion mechanism 24*b* is routed to the second economizer heat exchanger 62. At this time, a part of the refrigerant decompressed in the second heat-source-side expansion mechanism 24*b* and flowing in the second main heat-source-side flow path 22 branches off to the second economizer pipe 32.

The refrigerant that has been decompressed in the second heat-source-side expansion mechanism 24*b* and has branched off from the second main heat-source-side flow path 22 to the second economizer pipe 32 flows to the common part 35. Upon entering the common part 35, the refrigerant is decompressed by the expansion mechanism 36 of the common part 35 to an intermediate pressure in the refrigeration cycle. After being decompressed by the expansion mechanism 36 of the common part 35 to an intermediate pressure in the refrigeration cycle, the refrigerant branches off from the common part 35 to the second economizer pipe 32 again, and then flows to the second economizer heat exchanger 62. After branching off to the second economizer pipe 32 and entering the second economizer heat exchanger 62, the intermediate-pressure refrigerant in the refrigeration cycle exchanges heat in the second economizer heat exchanger 62 with the refrigerant flowing in the second main heat-source-side flow path 22. After exchanging heat in the second economizer heat exchanger 62 with the refrigerant flowing in the second main heat-source-side flow path 22, the intermediate-pressure refrigerant in the refrigeration cycle is routed via the intermediate refrigerant pipe 9 to the second compressor 12 of the higher stage.

The refrigerant decompressed in the second heat-source-side expansion mechanism 24*b* and routed to the second economizer heat exchanger 62 is cooled in the second economizer heat exchanger 62 through heat exchange with the refrigerant flowing in the second economizer pipe 32. After being cooled in the second economizer heat exchanger 62, the refrigerant is routed via the liquid-refrigerant connection pipe 2 to the use-side expansion mechanisms 103*a* and 103*c*.

The refrigerant routed via the liquid-refrigerant connection pipe 2 to the use-side expansion mechanisms 103*a* and 103*c* after undergoing heat exchange in the first economizer heat exchanger 61 and the second economizer heat exchanger 62 is decompressed in the use-side expansion mechanisms 103*a* and 103*c* and turns into low-pressure refrigerant in the refrigeration cycle that is in a two-phase gas-liquid state. After being decompressed in the use-side expansion mechanisms 103*a* and 103*c*, the low pressure refrigerant in the refrigeration cycle is routed to the use-side heat exchangers 102*a* and 102*c* respectively corresponding to the use-side expansion mechanisms 103*a* and 103*c*. The low pressure refrigerant in the refrigeration cycle routed to the use-side heat exchangers 102*a* and 102*c* evaporates through heat exchange with indoor air or other medium in the use-side heat exchangers 102*a* and 102*c* serving as evaporators for refrigerant. After evaporating in the use-side heat exchangers 102*a* and 102*c*, the low pressure refrigerant in the refrigeration cycle is passed through the low pressure gas-refrigerant connection pipe 4, the accumulator 95, and the suction pipe 8 before being sucked into the first compressor 11 again. In this way, the first operation is performed.

(3-2) Second Operation

Figure 4:
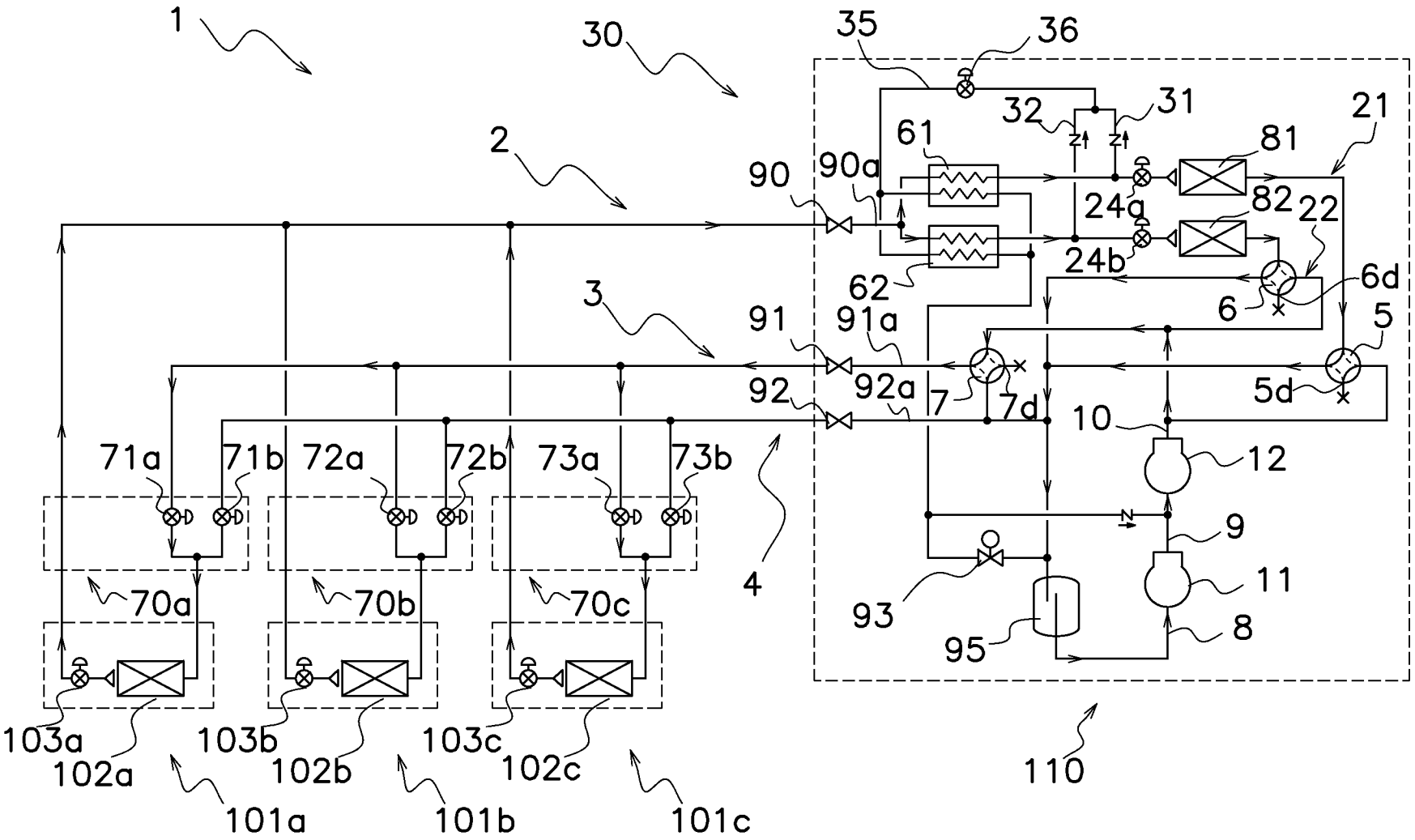
FIG. 4 is a schematic diagram illustrating how the air conditioner 1 performs a second operation.

Reference is now made to how the second operation is performed, by way of an example case where the control unit 120 causes the first use-side heat exchanger 102*a* and the third use-side heat exchanger 102*c* to function as radiators for refrigerant to perform heating, and deactivates the second use-side heat exchanger 102*b* (see FIG. 4).

In the second operation, the control unit 120 determines to cause the first heat-source-side heat exchanger 81 and the second heat-source-side heat exchanger 82 to function as evaporators for refrigerant. The control unit 120 switches the first heat-source-side switching mechanism 5, the second heat-source-side switching mechanism 6, and the third heat-source-side switching mechanism 7 to an evaporating operation state (in which the first heat-source-side switching mechanism 5, the second heat-source-side switching mechanism 6, and the third heat-source-side switching mechanism 7 are in the state shown by solid lines in FIG. 4). The control unit 120 closes the first branch-unit switching valve 72*a* and the second branch-unit switching valves 71*b*, 72*b*, and 73*b*, and opens the first branch-unit switching valves 71*a* and 73*a*.

With the refrigerant circuit 30 in the above-mentioned state (for the flow of refrigerant in this state, see arrows attached to the refrigerant circuit 30 in FIG. 4), low pressure refrigerant in the refrigeration cycle is sucked from the suction pipe 8 into the first compressor 11 of the lower stage. After being sucked into the first compressor 11 of the lower stage, the low pressure refrigerant in the refrigeration cycle is compressed in the first compressor 11 of the lower stage to an intermediate pressure in the refrigeration cycle before being discharged to the intermediate refrigerant pipe 9. After being discharged from the first compressor 11 of the lower stage to the intermediate refrigerant pipe 9, the intermediate-pressure refrigerant in the refrigeration cycle is sucked into the second compressor 12 of the higher stage, and compressed in the second compressor 12 to a high pressure in the refrigeration cycle before being discharged to the discharge pipe 10. At this time, the high pressure refrigerant in the refrigeration cycle discharged from the second compressor 12 of the higher stage has been compressed through the two-stage compression action of the compressors 11 and 12 to a pressure exceeding the critical pressure of the refrigerant. After being discharged from the second compressor 12 of the higher stage, the high pressure refrigerant in the refrigeration cycle is routed via the high/low pressure gas-refrigerant connection pipe 3 and the third heat-source-side switching mechanism 7 to the use-side heat exchangers 102*a* and 102*c*. The high pressure refrigerant in the refrigeration cycle routed to the use-side heat exchangers 102*a* and 102*c* rejects heat through heat exchange with indoor air or other medium in the use-side heat exchangers 102*a* and 102*c* serving as radiators for refrigerant. After rejecting heat in the use-side heat exchangers 102*a* and 102*c*, the high pressure refrigerant in the refrigeration cycle is routed to the use-side expansion mechanisms 103*a* and 103*c*. The high pressure refrigerant in the refrigeration cycle routed to the use-side expansion mechanisms 103*a* and 103*c* is decompressed in the use-side expansion mechanisms 103*a* and 103*c*. After being decompressed in the use-side expansion mechanisms 103*a* and 103*c*, the resulting refrigerant is routed via the liquid-refrigerant connection pipe 2 to the first heat-source-side expansion mechanism 24*a* and the second heat-source-side expansion mechanism 24*b*. The refrigerant routed to the first heat-source-side expansion mechanism 24*a* and the second heat-source-side expansion mechanism 24*b* is decompressed in the first heat-source-side expansion mechanism 24*a* and the second heat-source-side expansion mechanism 24*b* and turns into low-pressure refrigerant in the refrigeration cycle that is in a two-phase gas-liquid state. After being decompressed in the first heat-source-side expansion mechanism 24*a* and the second heat-source-side expansion mechanism 24*b*, the low pressure refrigerant in the refrigeration cycle is routed to the first heat-source-side heat exchanger 81 and the second heat-source-side heat exchanger 82. The low pressure refrigerant in the refrigeration cycle routed to the first heat-source-side heat exchanger 81 and the second heat-source-side heat exchanger 82 evaporates through heat exchange with outdoor air or other medium in the first heat-source-side heat exchanger 81 and the second heat-source-side heat exchanger 82 serving evaporators for refrigerant. The low pressure refrigerant in the refrigeration cycle that has evaporated in the first heat-source-side heat exchanger 81 is passed through the first heat-source-side switching mechanism 5, the accumulator 95, and the suction pipe 8 before being sucked into the first compressor 11 again. The low pressure refrigerant in the refrigeration cycle that has evaporated in the second heat-source-side heat exchanger 82 is passed through the second heat-source-side switching mechanism 6, the accumulator 95, and the suction pipe 8 before being sucked into the first compressor 11 again. In this way, the second operation is performed.

(3-3) Third Operation

The third operation is now described separately for the following three types of operations: the third operation A, the third operation B, and the third operation C.

(3-3-1) Third Operation A

Figure 5:
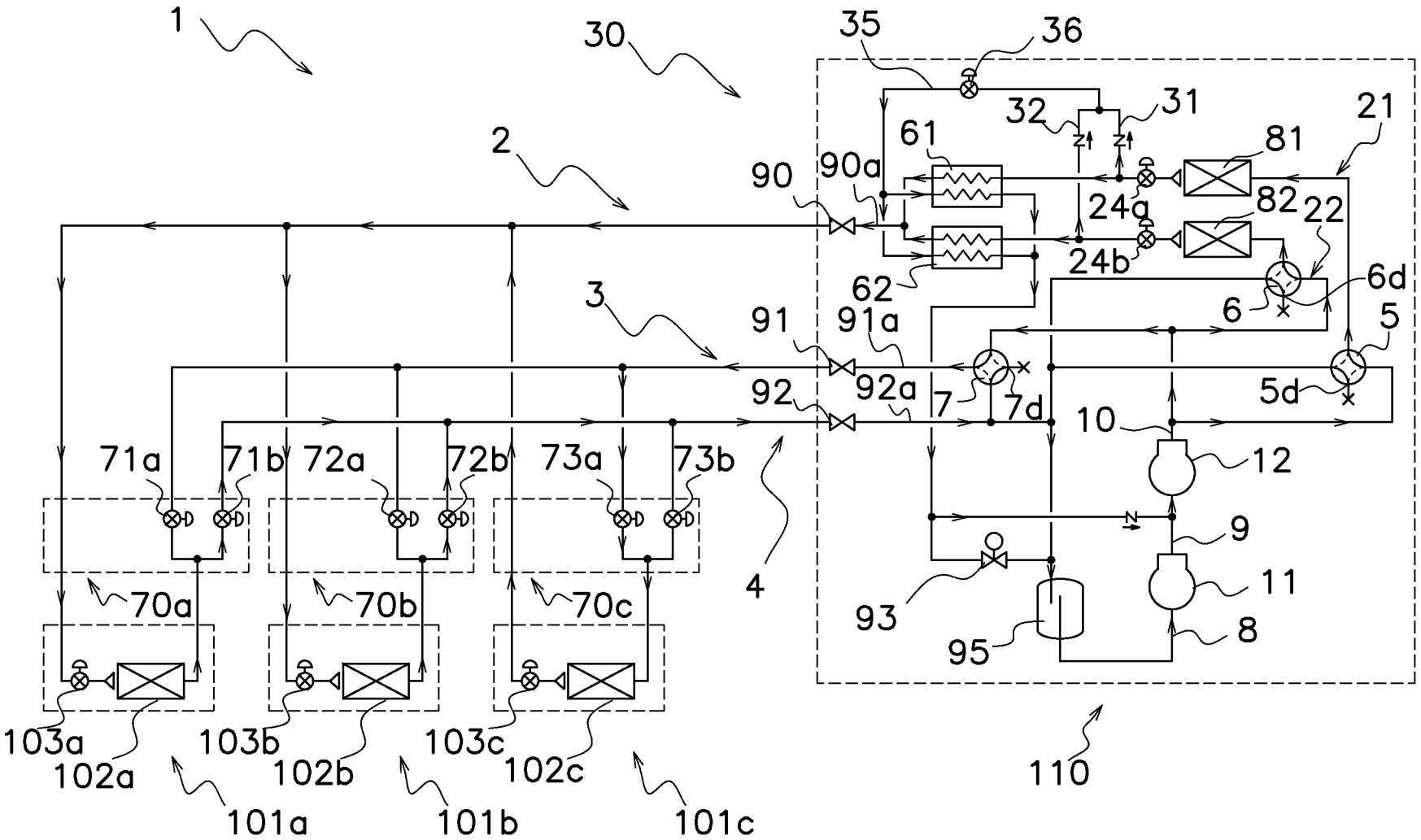
FIG. 5 is a schematic diagram illustrating how the air conditioner 1 performs a third operation A.

Reference is now made to how the third operation A is performed, by way of an example case where the control unit 120 causes the first use-side heat exchanger 102*a* and the second use-side heat exchanger 102*b* to function as evaporators for refrigerant to perform cooling, and causes the third use-side heat exchanger 102*c* to function as a radiator for refrigerant to perform heating (see FIG. 5).

In the third operation A, as with the first operation, the control unit 120 determines to cause the first heat-source-side heat exchanger 81 and the second heat-source-side heat exchanger 82 to function as radiators for refrigerant. Further, the control unit 120 determines to cause the third use-side heat exchanger 102*c* to function as a radiator for refrigerant. The control unit 120 switches the first heat-source-side switching mechanism 5 and the second heat-source-side switching mechanism 6 to a radiating operation state (in which the first heat-source-side switching mechanism 5 and the second heat-source-side switching mechanism 6 are in the state shown by solid lines in FIG. 5), and switches the third heat-source-side switching mechanism 7 to an evaporating operation state (in which the third heat-source-side switching mechanism 7 is in the state shown by solid lines in FIG. 5). The control unit 120 closes the first branch-unit switching valves 71*a* and 72*a* and the second branch-unit switching valve 73*b*, and opens the first branch-unit switching valve 73*a* and the second branch-unit switching valves 71*b* and 72*b*.

With the refrigerant circuit 30 in the above-mentioned state (for the flow of refrigerant in this state, see arrows attached to the refrigerant circuit 30 in FIG. 5), low pressure refrigerant in the refrigeration cycle is sucked from the suction pipe 8 into the first compressor 11 of the lower stage. After being sucked into the first compressor 11 of the lower stage, the low pressure refrigerant in the refrigeration cycle is compressed in the first compressor 11 of the lower stage to an intermediate pressure in the refrigeration cycle before being discharged to the intermediate refrigerant pipe 9. After being discharged from the first compressor 11 of the lower stage to the intermediate refrigerant pipe 9, the intermediate-pressure refrigerant in the refrigeration cycle is sucked into the second compressor 12 of the higher stage, and compressed in the second compressor 12 to a high pressure in the refrigeration cycle before being discharged to the discharge pipe 10. At this time, the high pressure refrigerant in the refrigeration cycle discharged from the second compressor 12 of the higher stage has been compressed through the two-stage compression action of the compressors 11 and 12 to a pressure exceeding the critical pressure of the refrigerant. After the high pressure refrigerant in the refrigeration cycle is discharged from the second compressor 12 of the higher stage, a part of the high pressure refrigerant flows from the discharge pipe 10 to the first main heat-source-side flow path 21 or the second main heat-source-side flow path 22, and the remainder is routed via the high/low pressure gas-refrigerant connection pipe 3 and the third heat-source-side switching mechanism 7 to the third use-side heat exchanger 102*c*.

The refrigerant that has flown from the discharge pipe 10 to the first main heat-source-side flow path 21 is routed via the first heat-source-side switching mechanism 5 to the first heat-source-side heat exchanger 81. The high pressure refrigerant in the refrigeration cycle routed to the first heat-source-side heat exchanger 81 rejects heat through heat exchange with outdoor air or other medium in the first heat-source-side heat exchanger 81 serving as a radiator for refrigerant. After rejecting heat in the first heat-source-side heat exchanger 81, the high pressure refrigerant in the refrigeration cycle is decompressed in the first heat-source-side expansion mechanism 24*a*. The refrigerant decompressed in the first heat-source-side expansion mechanism 24*a* is routed to the first economizer heat exchanger 61. At this time, a part of the refrigerant decompressed in the first heat-source-side expansion mechanism 24*a* and flowing in the first main heat-source-side flow path 21 branches off to the first economizer pipe 31.

The refrigerant that has been decompressed in the first heat-source-side expansion mechanism 24*a* and has branched off from the first main heat-source-side flow path 21 to the first economizer pipe 31 flows to the common part 35. Upon entering the common part 35, the refrigerant is decompressed by the expansion mechanism 36 of the common part 35 to an intermediate pressure in the refrigeration cycle. After being decompressed by the expansion mechanism 36 of the common part 35 to an intermediate pressure in the refrigeration cycle, the refrigerant branches off from the common part 35 to the first economizer pipe 31 again, and then flows to the first economizer heat exchanger 61. After branching off from the common part 35 to the first economizer pipe 31 and then flowing to the first economizer heat exchanger 61, the intermediate-pressure refrigerant in the refrigeration cycle exchanges heat in the first economizer heat exchanger 61 with the refrigerant flowing in the first main heat-source-side flow path 21. After exchanging heat in the first economizer heat exchanger 61 with the refrigerant flowing in the first main heat-source-side flow path 21, the intermediate-pressure refrigerant in the refrigeration cycle is routed via the intermediate refrigerant pipe 9 to the second compressor 12 of the higher stage.

The refrigerant flowing in the first main heat-source-side flow path 21 that has been decompressed in the first heat-source-side expansion mechanism 24*a* and routed to the first economizer heat exchanger 61 is cooled in the first economizer heat exchanger 61 through heat exchange with the refrigerant flowing in the first economizer pipe 31. After being cooled in the first economizer heat exchanger 61, the refrigerant flowing in the first main heat-source-side flow path 21 is routed via the liquid-refrigerant connection pipe 2 to the use-side expansion mechanisms 103*a* and 103*b*.

The refrigerant that has flown from the discharge pipe 10 to the second main heat-source-side flow path 22 is routed via the second heat-source-side switching mechanism 6 to the second heat-source-side heat exchanger 82. The high pressure refrigerant in the refrigeration cycle passed to the second main heat-source-side flow path 22 and then routed to the second heat-source-side heat exchanger 82 rejects heat through heat exchange with outdoor air or other medium in the second heat-source-side heat exchanger 82 serving as a radiator for refrigerant. After rejecting heat in the second heat-source-side heat exchanger 82, the high pressure refrigerant in the refrigeration cycle is decompressed in the second heat-source-side expansion mechanism 24*b*. The refrigerant decompressed in the second heat-source-side expansion mechanism 24*b* is routed to the second economizer heat exchanger 62. At this time, a part of the refrigerant decompressed in the second heat-source-side expansion mechanism 24*b* and flowing in the second main heat-source-side flow path 22 branches off to the second economizer pipe 32.

The refrigerant that has been decompressed in the second heat-source-side expansion mechanism 24*b* and has branched off from the second main heat-source-side flow path 22 to the second economizer pipe 32 flows to the common part 35. Upon entering the common part 35, the refrigerant is decompressed by the expansion mechanism 36 of the common part 35 to an intermediate pressure in the refrigeration cycle. After being decompressed by the expansion mechanism 36 of the common part 35 to an intermediate pressure in the refrigeration cycle, the refrigerant branches off from the common part 35 to the second economizer pipe 32 again, and then flows to the second economizer heat exchanger 62. After branching off from the common part 35 to the second economizer pipe 32 again and then flowing to the second economizer heat exchanger 62, the intermediate-pressure refrigerant in the refrigeration cycle exchanges heat in the second economizer heat exchanger 62 with the refrigerant flowing in the second main heat-source-side flow path 22. After exchanging heat in the second economizer heat exchanger 62 with the refrigerant flowing in the second main heat-source-side flow path 22, the intermediate-pressure refrigerant in the refrigeration cycle is routed via the intermediate refrigerant pipe 9 to the second compressor 12 of the higher stage.

The refrigerant decompressed in the second heat-source-side expansion mechanism 24*b* and routed to the second economizer heat exchanger 62 is cooled in the second economizer heat exchanger 62 through heat exchange with the refrigerant flowing in the second economizer pipe 32. After being cooled in the second economizer heat exchanger 62, the refrigerant is routed via the liquid-refrigerant connection pipe 2 to the use-side expansion mechanisms 103*a* and 103*b*.

Meanwhile, the high pressure refrigerant in the refrigeration cycle routed to the third use-side heat exchanger 102*c* rejects heat through heat exchange with indoor air or other medium in the third use-side heat exchanger 102*c* serving as a radiator for refrigerant. After rejecting heat in the third use-side heat exchanger 102*c*, the high pressure refrigerant in the refrigeration cycle is routed to the third use-side expansion mechanism 103*c*. The high pressure refrigerant in the refrigeration cycle routed to the third use-side expansion mechanism 103*c* is decompressed in the third use-side expansion mechanism 103*c*. The refrigerant decompressed in the third use-side expansion mechanism 103*c* is merged in the liquid-refrigerant connection pipe 2 with the refrigerant that has undergone heat exchange in each of the first economizer heat exchanger 61 and the second economizer heat exchanger 62. After these streams of refrigerant are merged in the liquid-refrigerant connection pipe 2, the resulting merged refrigerant is routed to the use-side expansion mechanisms 103*a* and 103*b*.

The refrigerant routed to the use-side expansion mechanisms 103*a* and 103*b* is decompressed in the use-side expansion mechanisms 103*a* and 103*b* and turns into low-pressure refrigerant in the refrigeration cycle that is in a two-phase gas-liquid state. After being decompressed in the use-side expansion mechanisms 103*a* and 103*b*, the low pressure refrigerant in the refrigeration cycle is routed to the use-side heat exchangers 102*a* and 102*b* respectively corresponding to the use-side expansion mechanisms 103*a* and 103*b*. The low pressure refrigerant in the refrigeration cycle routed to the use-side heat exchangers 102*a* and 102*b* evaporates through heat exchange with indoor air or other medium in the use-side heat exchangers 102*a* and 102*b* serving as evaporators for refrigerant. After evaporating in the use-side heat exchangers 102*a* and 102*b*, the low pressure refrigerant in the refrigeration cycle is passed through the low pressure gas-refrigerant connection pipe 4, the accumulator 95, and the suction pipe 8 before being sucked into the first compressor 11 again.

(3-3-1-1)

In performing the third operation A, the control unit 120 may in some cases determine that the overall evaporation load on the use-side heat exchangers is small, due to reasons such as a small number of use-side heat exchangers that are acting as evaporators for refrigerant. In such cases, the control unit 120 determines to cause the first heat-source-side heat exchanger 81 to function as a radiator for refrigerant, and to cause the second heat-source-side heat exchanger 82 to function as an evaporator for refrigerant. As the control unit 120 performs such control, the radiation load on the first heat-source-side heat exchanger 81 and the evaporation load on the second heat-source-side heat exchanger 82 are balanced out, which allows for reduced overall radiation load on the heat-source-side heat exchangers (see FIG. 6).

Figure 6:
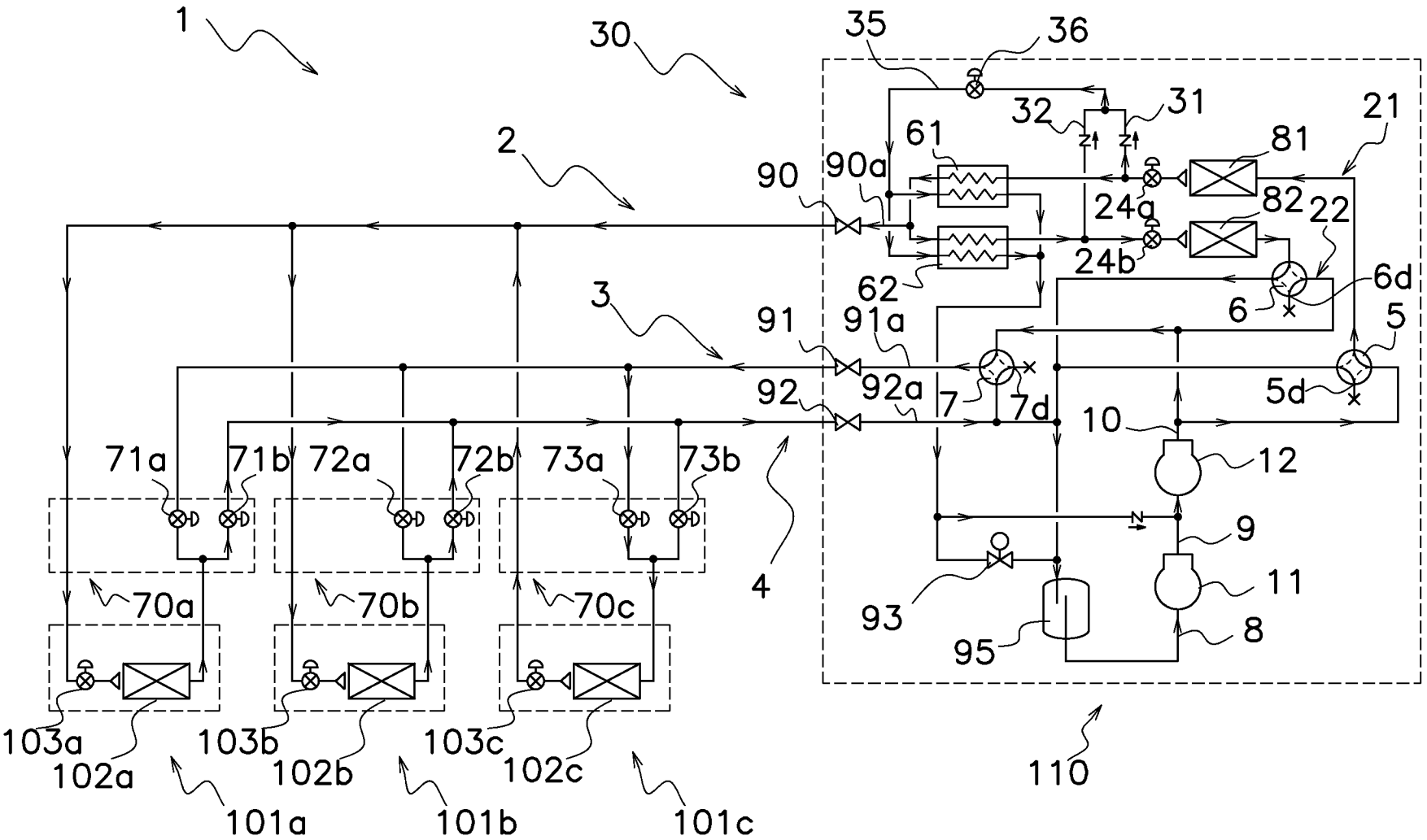
FIG. 6 is a schematic diagram illustrating how the air conditioner 1 performs the third operation A if the overall evaporation load on use-side heat exchangers is small.

When performing the above-mentioned operation, the control unit 120 switches the first heat-source-side switching mechanism 5 to a radiating operation state (in which the first heat-source-side switching mechanism 5 is in the state shown by solid lines in FIG. 6), and switches the second heat-source-side switching mechanism 6 and the third heat-source-side switching mechanism 7 to an evaporating operation state (in which the second heat-source-side switching mechanism 6 and the third heat-source-side switching mechanism 7 are in the state shown by solid lines in FIG. 6).

With the refrigerant circuit 30 in the above-mentioned state (for the flow of refrigerant in this state, see the arrows attached to the refrigerant circuit 30 in FIG. 6), the refrigerant passed to the first main heat-source-side flow path 21 is routed to the first heat-source-side heat exchanger 81 serving as a radiator for refrigerant, and undergoes heat exchange in the first heat-source-side heat exchanger 81. After undergoing heat exchange in the first heat-source-side heat exchanger 81, the refrigerant is routed to the first heat-source-side expansion mechanism 24*a*, and decompressed in the first heat-source-side expansion mechanism 24*a*. At this time, a part of the refrigerant decompressed in the first heat-source-side expansion mechanism 24*a* flows to the first economizer pipe 31, and the remainder is routed to the first economizer heat exchanger 61.

The refrigerant that has been decompressed in the first heat-source-side expansion mechanism 24*a* and has branched off from the first main heat-source-side flow path 21 to the first economizer pipe 31 flows to the common part 35. Upon entering the common part 35, the refrigerant is decompressed by the expansion mechanism 36 of the common part 35 to an intermediate pressure in the refrigeration cycle. After being decompressed by the expansion mechanism 36 of the common part 35 to an intermediate pressure in the refrigeration cycle, the refrigerant branches off from the common part 35 to the first economizer pipe 31 again, and then flows to the first economizer heat exchanger 61. After branching off from the common part 35 to the first economizer pipe 31 and then flowing to the first economizer heat exchanger 61, the intermediate-pressure refrigerant in the refrigeration cycle exchanges heat in the first economizer heat exchanger 61 with the refrigerant flowing in the first main heat-source-side flow path 21. After exchanging heat in the first economizer heat exchanger 61 with the refrigerant flowing in the first main heat-source-side flow path 21, the intermediate-pressure refrigerant in the refrigeration cycle is routed via the intermediate refrigerant pipe 9 to the second compressor 12 of the higher stage.

The refrigerant flowing in the first main heat-source-side flow path 21 that has been decompressed in the first heat-source-side expansion mechanism 24*a* and routed to the first economizer heat exchanger 61 is cooled in the first economizer heat exchanger 61 through heat exchange with the refrigerant flowing in the first economizer pipe 31. A part of the refrigerant flowing in the first main heat-source-side flow path 21 after undergoing heat exchange in the first economizer heat exchanger 61 is routed via the liquid-refrigerant connection pipe 2 to the use-side expansion mechanisms 103*a* and 103*b*, and the remainder flows to the second main heat-source-side flow path 22.

The refrigerant that has flown to the second main heat-source-side flow path 22 is decompressed in the second heat-source-side expansion mechanism 24*b* before being routed to the second heat-source-side heat exchanger 82. After being decompressed in the second heat-source-side expansion mechanism 24*b*, the resulting low pressure refrigerant in the refrigeration cycle evaporates through heat exchange with outdoor air or other medium in the second heat-source-side heat exchanger 82 serving as an evaporator for refrigerant. The low pressure refrigerant in the refrigeration cycle that has evaporated in the second heat-source-side heat exchanger 82 is passed through the second heat-source-side switching mechanism 6, the accumulator 95, and the suction pipe 8 before being sucked into the first compressor 11 again.

Meanwhile, the high pressure refrigerant routed from the discharge pipe 10 to the third use-side heat exchanger 102*c* rejects heat through heat exchange with indoor air or other medium in the third use-side heat exchanger 102*c* serving as a radiator for refrigerant. After rejecting heat in the third use-side heat exchanger 102*c*, the high pressure refrigerant in the refrigeration cycle is routed to the third use-side expansion mechanism 103*c*. The high pressure refrigerant in the refrigeration cycle routed to the third use-side expansion mechanism 103*c* is decompressed in the third use-side expansion mechanism 103*c*. The refrigerant decompressed in the third use-side expansion mechanism 103*c* is merged in the liquid-refrigerant connection pipe 2 with the refrigerant that has undergone heat exchange in the first economizer heat exchanger 61. After these streams of refrigerant are merged in the liquid-refrigerant connection pipe 2, the resulting merged refrigerant is routed to the use-side expansion mechanisms 103*a* and 103*b*.

The refrigerant routed to the use-side expansion mechanisms 103*a* and 103*b* is decompressed in the use-side expansion mechanisms 103*a* and 103*b* and turns into low-pressure refrigerant in the refrigeration cycle that is in a two-phase gas-liquid state. After being decompressed in the use-side expansion mechanisms 103*a* and 103*b*, the low pressure refrigerant in the refrigeration cycle is routed to the use-side heat exchangers 102*a* and 102*b* respectively corresponding to the use-side expansion mechanisms 103*a* and 103*b*. The low pressure refrigerant in the refrigeration cycle routed to the use-side heat exchangers 102*a* and 102*b* evaporates through heat exchange with indoor air or other medium in the use-side heat exchangers 102*a* and 102*b* serving as evaporators for refrigerant. After evaporating in the use-side heat exchangers 102*a* and 102*b*, the low pressure refrigerant in the refrigeration cycle is passed through the low pressure gas-refrigerant connection pipe 4, the accumulator 95, and the suction pipe 8 before being sucked into the first compressor 11 again. In this way, the third operation A is performed.

(3-3-2) Third Operation B

Figure 7:
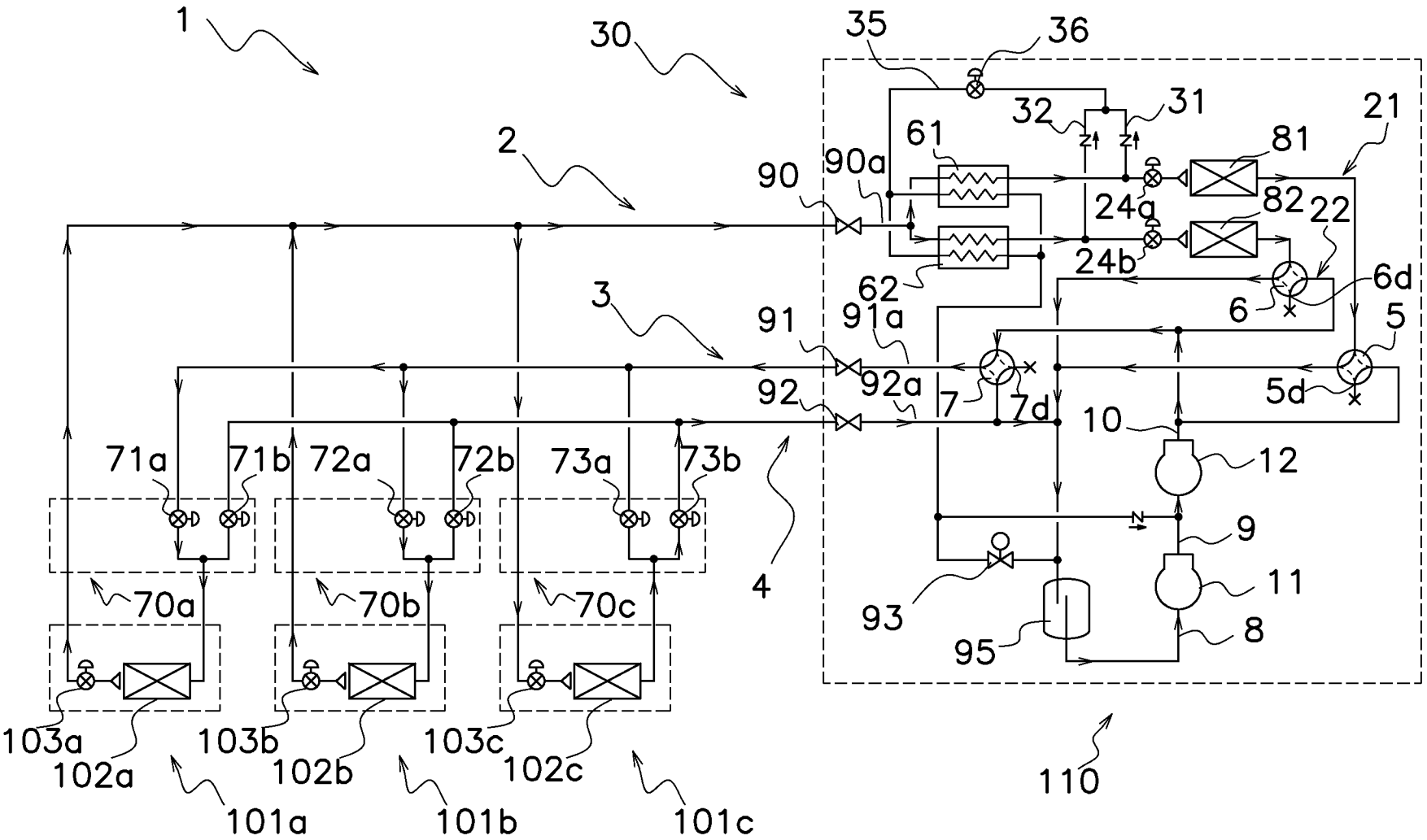
FIG. 7 is a schematic diagram illustrating how the air conditioner 1 performs a third operation B.

Reference is now made to how the third operation B is performed, by way of an example case where the control unit 120 causes the first use-side heat exchanger 102*a* and the second use-side heat exchanger 102*b* to function as radiators for refrigerant to perform heating, and causes the third use-side heat exchanger 102*c* to function as an evaporator for refrigerant to perform cooling (see FIG. 7).

In the third operation B, as with the second operation, the control unit 120 determines to cause the first heat-source-side heat exchanger 81 and the second heat-source-side heat exchanger 82 to function as evaporators for refrigerant. The control unit 120 switches the first heat-source-side switching mechanism 5, the second heat-source-side switching mechanism 6, and the third heat-source-side switching mechanism 7 to an evaporating operation state (in which the first heat-source-side switching mechanism 5, the second heat-source-side switching mechanism 6, and the third heat-source-side switching mechanism 7 are in the state shown by solid lines in FIG. 7). The control unit 120 closes the first branch-unit switching valve 73*a* and the second branch-unit switching valves 71*b* and 72*b*, and opens the first branch-unit switching valves 71*a* and 72*a* and the second branch-unit switching valve 73*b*.

With the refrigerant circuit 30 in the above-mentioned state (for the flow of refrigerant in this state, see arrows attached to the refrigerant circuit 30 in FIG. 7), low pressure refrigerant in the refrigeration cycle is sucked from the suction pipe 8 into the first compressor 11 of the lower stage. After being sucked into the first compressor 11 of the lower stage, the low pressure refrigerant in the refrigeration cycle is compressed in the first compressor 11 of the lower stage to an intermediate pressure in the refrigeration cycle before being discharged to the intermediate refrigerant pipe 9. After being discharged from the first compressor 11 of the lower stage to the intermediate refrigerant pipe 9, the intermediate-pressure refrigerant in the refrigeration cycle is sucked into the second compressor 12 of the higher stage, and compressed in the second compressor 12 to a high pressure in the refrigeration cycle before being discharged to the discharge pipe 10. At this time, the high pressure refrigerant in the refrigeration cycle discharged from the second compressor 12 of the higher stage has been compressed through the two-stage compression action of the compressors 11 and 12 to a pressure exceeding the critical pressure of the refrigerant. After being discharged from the second compressor 12 of the higher stage, the high pressure refrigerant in the refrigeration cycle is routed via the high/low pressure gas-refrigerant connection pipe 3 and the third heat-source-side switching mechanism 7 to the use-side heat exchangers 102*a* and 102*b*. The high pressure refrigerant in the refrigeration cycle routed to the use-side heat exchangers 102*a* and 102*b* rejects heat through heat exchange with indoor air or other medium in the use-side heat exchangers 102*a* and 102*b* serving as radiators for refrigerant. After rejecting heat in the use-side heat exchangers 102*a* and 102*b*, the high pressure refrigerant in the refrigeration cycle is routed to the use-side expansion mechanisms 103*a* and 103*b*. The high pressure refrigerant in the refrigeration cycle routed to the use-side expansion mechanisms 103*a* and 103*b* is decompressed in the use-side expansion mechanisms 103*a* and 103*b*. After being decompressed in the use-side expansion mechanisms 103*a* and 103*b*, a part of the refrigerant is routed via the liquid-refrigerant connection pipe 2 to the first heat-source-side expansion mechanism 24*a* and the second heat-source-side expansion mechanism 24*b*, and the remainder branches off from the liquid-refrigerant connection pipe 2 and is routed to the third use-side expansion mechanism 103*c*.

The refrigerant routed to the first heat-source-side expansion mechanism 24*a* and the second heat-source-side expansion mechanism 24*b* is decompressed in the first heat-source-side expansion mechanism 24*a* and the second heat-source-side expansion mechanism 24*b* and turns into low-pressure refrigerant in the refrigeration cycle that is in a two-phase gas-liquid state. After being decompressed in the first heat-source-side expansion mechanism 24*a* and the second heat-source-side expansion mechanism 24*b*, the low pressure refrigerant in the refrigeration cycle is routed to the first heat-source-side heat exchanger 81 and the second heat-source-side heat exchanger 82. The low pressure refrigerant in the refrigeration cycle that has evaporated in the first heat-source-side heat exchanger 81 is passed through the first heat-source-side switching mechanism 5, the accumulator 95, and the suction pipe 8 before being sucked into the first compressor 11 again. The low pressure refrigerant in the refrigeration cycle that has evaporated in the second heat-source-side heat exchanger 82 is passed through the second heat-source-side switching mechanism 6, the accumulator 95, and the suction pipe 8 before being sucked into the first compressor 11 again.

Meanwhile, the refrigerant routed to the third use-side expansion mechanism 103*c* is decompressed in the third use-side expansion mechanism 103*c* and turns into low-pressure refrigerant in the refrigeration cycle that is in a two-phase gas-liquid state. After being decompressed in the third use-side expansion mechanism 103*c*, the low pressure refrigerant in the refrigeration cycle is routed to the third use-side heat exchanger 102*c* corresponding to the third use-side expansion mechanism 103*c*. The low pressure refrigerant in the refrigeration cycle routed to the third use-side heat exchanger 102*c* evaporates through heat exchange with indoor air or other medium in the third use-side heat exchanger 102*c* serving as an evaporator for refrigerant. After evaporating in the third use-side heat exchanger 102*c*, the low pressure refrigerant in the refrigeration cycle is routed via the low pressure gas-refrigerant connection pipe 4, the accumulator 95, and the suction pipe 8 to the first compressor 11.

(3-3-3) Third Operation C

Figure 8:
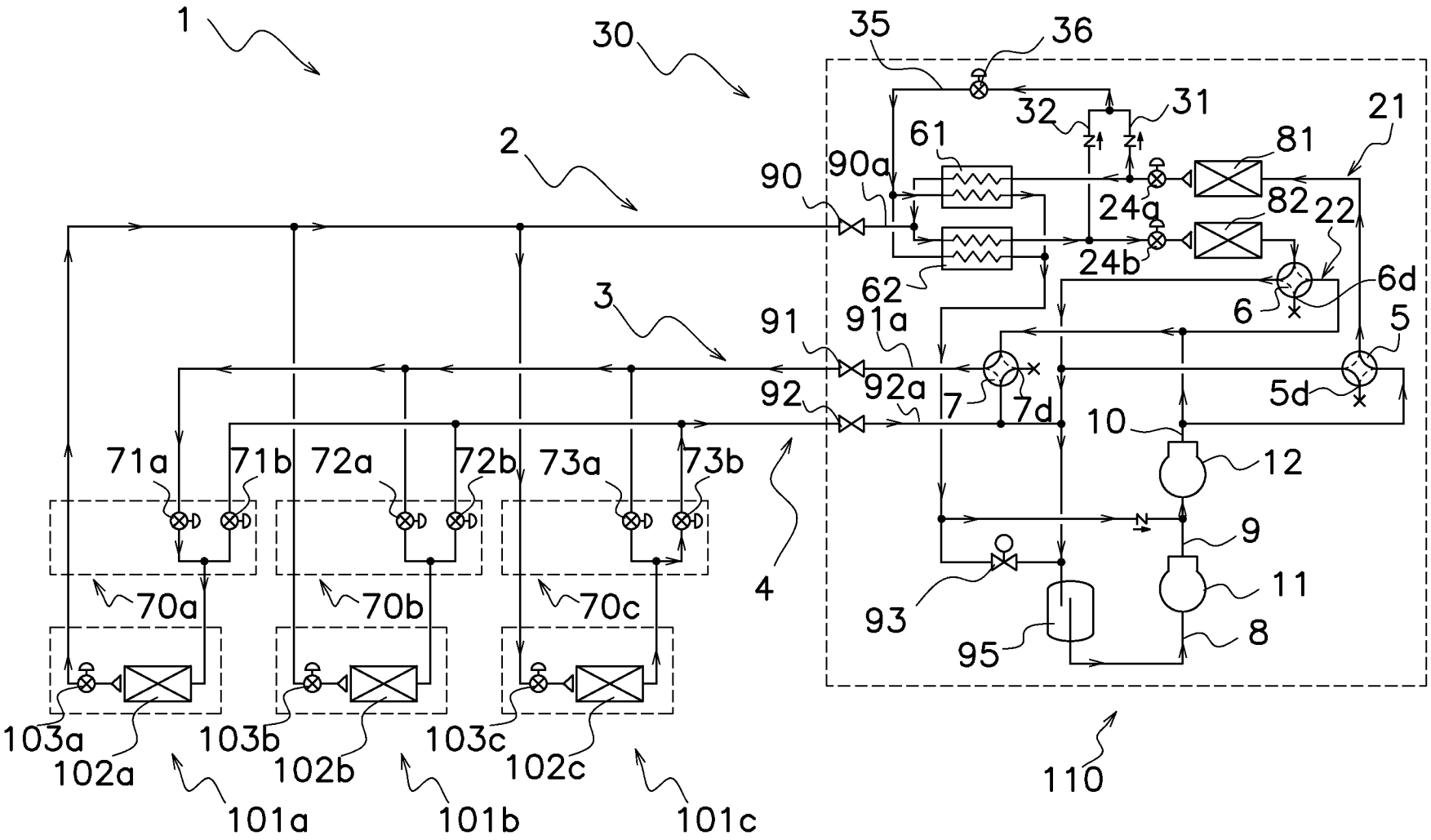
FIG. 8 is a schematic diagram illustrating how the air conditioner 1 performs a third operation C.

Reference is now made to how the third operation C is performed, by way of an example case where the control unit 120 causes the first use-side heat exchanger 102*a* to function as a radiator for refrigerant to perform heating, deactivates the second use-side heat exchanger 102*b*, and causes the third use-side heat exchanger 102*c* to function as an evaporator for refrigerant to perform cooling (see FIG. 8).

In the third operation C, the control unit 120 determines that the first heat-source-side heat exchanger 81 and the second heat-source-side heat exchanger 82 respectively have a small radiation load and a small evaporation load. The control unit 120 switches the first heat-source-side switching mechanism 5 to a radiating operation state shown by solid lines in FIG. 8, and switches the second heat-source-side switching mechanism 6 and the third heat-source-side switching mechanism 7 to an evaporating operation state shown by solid lines in FIG. 8. The control unit 120 closes the first branch-unit switching valves 72*a* and 73*a* and the second branch-unit switching valves 71*b* and 72*b*, and opens the first branch-unit switching valve 71*a* and the second branch-unit switching valve 73*b*.

With the refrigerant circuit 30 in the above-mentioned state (for the flow of refrigerant in this state, see arrows attached to the refrigerant circuit 30 in FIG. 8), low pressure refrigerant in the refrigeration cycle is sucked from the suction pipe 8 into the first compressor 11 of the lower stage. After being sucked into the first compressor 11 of the lower stage, the low pressure refrigerant in the refrigeration cycle is compressed in the first compressor 11 of the lower stage to an intermediate pressure in the refrigeration cycle before being discharged to the intermediate refrigerant pipe 9. The intermediate-pressure refrigerant in the refrigeration cycle discharged from the first compressor 11 of the lower stage is compressed in the second compressor 12 of the higher stage to a high pressure in the refrigeration cycle, and then discharged from the second compressor 12 of the higher stage to the discharge pipe 10. At this time, the high pressure refrigerant in the refrigeration cycle discharged from the second compressor 12 of the higher stage has been compressed through the two-stage compression action of the compressors 11 and 12 to a pressure exceeding the critical pressure of the refrigerant. After the high pressure refrigerant in the refrigeration cycle is discharged to the discharge pipe 10 from the second compressor 12 of the higher stage, a part of the high pressure refrigerant is routed to the first heat-source-side heat exchanger 81, and the remainder is routed to the first use-side heat exchanger 102*a*.

The high pressure refrigerant in the refrigeration cycle routed to the first heat-source-side heat exchanger 81 rejects heat through heat exchange with outdoor air or other medium in the first heat-source-side heat exchanger 81 serving as a radiator for refrigerant. After rejecting heat in the first heat-source-side heat exchanger 81, the high pressure refrigerant in the refrigeration cycle is decompressed in the first heat-source-side expansion mechanism 24*a*. The refrigerant decompressed in the first heat-source-side expansion mechanism 24*a* is routed to the first economizer heat exchanger 61. At this time, a part of the refrigerant decompressed in the first heat-source-side expansion mechanism

24*a* and flowing in the first main heat-source-side flow path 21 branches off to the first economizer pipe 31.

The refrigerant that has been decompressed in the first heat-source-side expansion mechanism 24*a* and has branched off from the first main heat-source-side flow path 21 to the first economizer pipe 31 flows to the common part 35. Upon entering the common part 35, the refrigerant is decompressed by the expansion mechanism 36 of the common part 35 to an intermediate pressure in the refrigeration cycle. After being decompressed by the expansion mechanism 36 of the common part 35 to an intermediate pressure in the refrigeration cycle, the refrigerant branches off from the common part 35 to the first economizer pipe 31 again, and then flows to the first economizer heat exchanger 61. After branching off from the common part 35 to the first economizer pipe 31 and then flowing to the first economizer heat exchanger 61, the intermediate-pressure refrigerant in the refrigeration cycle exchanges heat in the first economizer heat exchanger 61 with the refrigerant flowing in the first main heat-source-side flow path 21. After exchanging heat in the first economizer heat exchanger 61 with the refrigerant flowing in the first main heat-source-side flow path 21, the intermediate-pressure refrigerant in the refrigeration cycle is routed via the intermediate refrigerant pipe 9 to the second compressor 12 of the higher stage.

The refrigerant flowing in the first main heat-source-side flow path 21 that has been decompressed in the first heat-source-side expansion mechanism 24*a* and routed to the first economizer heat exchanger 61 is cooled in the first economizer heat exchanger 61 through heat exchange with the refrigerant flowing in the first economizer pipe 31. The refrigerant flowing in the first main heat-source-side flow path 21 after being cooled in the first economizer heat exchanger 61 flows to the second main heat-source-side flow path 22, and is routed to the second heat-source-side expansion mechanism 24*b*. The refrigerant routed to the second heat-source-side expansion mechanism 24*b* is decompressed in the second heat-source-side expansion mechanism 24*b* and turns into low-pressure refrigerant in the refrigeration cycle that is in a two-phase gas-liquid state. After being decompressed in the second heat-source-side expansion mechanism 24*b*, the low pressure refrigerant in the refrigeration cycle is routed to the second heat-source-side heat exchanger 82. The low pressure refrigerant routed to the second heat-source-side heat exchanger 82 evaporates through heat exchange with outdoor air or other medium in the second heat-source-side heat exchanger 82 serving as an evaporator for refrigerant. The low pressure refrigerant in the refrigeration cycle that has evaporated in the second heat-source-side heat exchanger 82 is passed through the second heat-source-side switching mechanism 6, the accumulator 95, and the suction pipe 8 before being sucked into the first compressor 11.

Meanwhile, the high pressure refrigerant routed from the discharge pipe 10 to the first use-side heat exchanger 102*a* rejects heat through heat exchange with indoor air or other medium in the first use-side heat exchanger 102*a* serving as a radiator for refrigerant. After rejecting heat in the first use-side heat exchanger 102*a*, the high pressure refrigerant in the refrigeration cycle is routed to the first use-side expansion mechanism 103*a*. The high pressure refrigerant in the refrigeration cycle routed to the first use-side expansion mechanism 103*a* is decompressed in the first use-side expansion mechanism 103*a*. After being decompressed in the first use-side expansion mechanism 103*a*, the refrigerant is routed via the liquid-refrigerant connection pipe 2 to the third use-side expansion mechanism 103*c*. The refrigerant routed to the third use-side expansion mechanism 103*c* is decompressed in the third use-side expansion mechanism 103*c* and turns into low-pressure refrigerant in the refrigeration cycle that is in a two-phase gas-liquid state. After being decompressed in the third use-side expansion mechanism 103*c*, the low pressure refrigerant in the refrigeration cycle is routed to the third use-side heat exchanger 102*c*. The low pressure refrigerant in the refrigeration cycle routed to the third use-side heat exchanger 102*c* evaporates through heat exchange with indoor air or other medium in the third use-side heat exchanger 102*c* serving as an evaporator for refrigerant. After evaporating in the third use-side heat exchanger 102*c*, the low pressure refrigerant in the refrigeration cycle is passed through the low pressure gas-refrigerant connection pipe 4, the accumulator 95, and the suction pipe 8 and sucked into the first compressor 11. In this way, the third operation C is performed.

(4) Characteristic Features (4-1)

As described above in the section (3-3-1-1), in performing the third operation A, the control unit 120 may in some cases determine that the overall evaporation load on the use-side heat exchangers is small, due to reasons such as a small number of use-side heat exchangers that are acting as evaporators for refrigerant. In such cases, the control unit 120 causes the first heat-source-side heat exchanger 81 to function as a radiator for refrigerant, and causes the second heat-source-side heat exchanger 82 to function as an evaporator for refrigerant so that the radiation load on the first heat-source-side heat exchanger 81 and the evaporation load on the second heat-source-side heat exchanger 82 are balanced out. In this way, the control unit 120 performs an operation for reducing the overall radiation load on the heat-source-side heat exchangers.

As described above in the section (3-3-3), in performing the third operation C, the control unit 120 determines that the first heat-source-side heat exchanger 81 and the second heat-source-side heat exchanger 82 respectively have a small radiation load and a small evaporation load. In this case, the control unit 120 causes the first heat-source-side heat exchanger 81 to function as a radiator for refrigerant, and causes the second heat-source-side heat exchanger 82 to function as an evaporator for refrigerant so that the radiation load on the first heat-source-side heat exchanger 81 and the evaporation load on the second heat-source-side heat exchanger 82 are balanced out.

As described above, when an air conditioner with plural heat-source-side heat exchangers is to perform a cooling and heating simultaneous operation, the air conditioner may sometimes operate such that a part or all of refrigerant that has passed through one heat-source-side heat exchanger serving as a radiator flows to another heat-source-side heat exchanger serving as an evaporator, and the remainder of the refrigerant flows to a use-side unit. By operating in this way, the air conditioner with plural heat-source-side heat exchangers is able to handle a small thermal load for the heat-source-side heat exchangers as a whole during the cooling and heating simultaneous operation.

Figure 9:
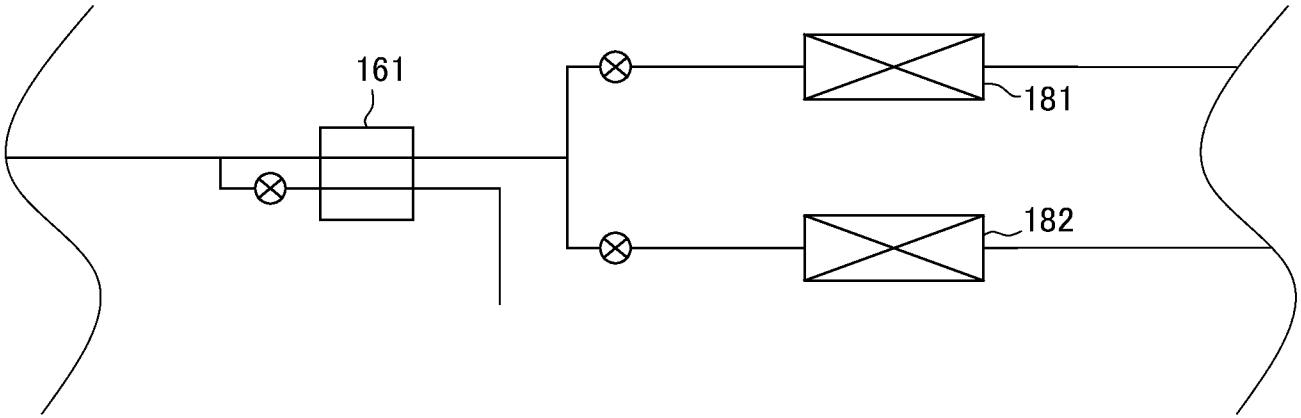
FIG. 9 is a schematic diagram illustrating an example of the related art related to an air conditioner.

Some multi-split air conditioners with plural heat-source-side heat exchangers and plural use-side units in the related art are designed such that whether to perform a cooling operation or a heating operation can be freely selected for each individual use-side unit. One conceivable way to improve the operating efficiency of such an air conditioner is to employ a configuration in which separate streams of refrigerant that have undergone heat exchange in plural heat-source-side heat exchangers 181 and 182 are merged before undergoing heat exchange in a single economizer heat exchanger 161 (see FIG. 9).

If an air conditioner employing the above-mentioned configuration is to perform the operation described above in the section (3-3-1-1), a part of the refrigerant that passes through one heat-source-side heat exchanger serving as a radiator for refrigerant and is then routed to a use-side unit flows through an economizer heat exchanger. However, the refrigerant that passes through one heat-source-side heat exchanger serving as a radiator for refrigerant and is then routed to another heat-source-side heat exchanger does not flow through an economizer heat exchanger.

If the operation described above in the section (3-3-3) is to be performed, the refrigerant having passed through one heat-source-side heat exchanger serving as a radiator for refrigerant is routed to another heat-source-side heat exchanger serving as an evaporator for refrigerant. Consequently, such refrigerant does not flow through an economizer heat exchanger.

In the case of an air conditioner employing the above-mentioned configuration in which separate streams of refrigerant that have undergone heat exchange in plural heat-source-side heat exchangers are merged before undergoing heat exchange in a single economizer heat exchanger, such an air conditioner is subject to situations where, during cooling and heating simultaneous operation, sufficient heat exchange does not take place as only a part of the refrigerant flows through the economizer heat exchanger.

In the air conditioner 1 according to the present disclosure, the first economizer heat exchanger 61 is connected in series with the first heat-source-side heat exchanger 81, and the second economizer heat exchanger 62 is connected in series with the second heat-source-side heat exchanger 82.

The air conditioner 1 according to the present disclosure employs the above-mentioned configuration so that the refrigerant flowing in the first main heat-source-side flow path 21 passes through the first heat-source-side heat exchanger 81 and the first economizer heat exchanger 61 before flowing to the use-side units 101*a* and 101*b* or to the second heat-source-side heat exchanger 82. This ensures that in performing the cooling and heating simultaneous operation as described above in the section (3-3-1-1) or (3-3-3), sufficient heat exchange takes place in the economizer heat exchangers 61 and 62.

(4-2)

In performing the first operation or the third operation A, the first heat-source-side heat exchanger 81 and the second heat-source-side heat exchanger 82 are caused to function as radiators. In the air conditioner 1 according to the present disclosure, the first economizer heat exchanger 61 is connected in series with the first heat-source-side heat exchanger 81, and the second economizer heat exchanger 62 is connected in series with the second heat-source-side heat exchanger 82. The air conditioner 1 according to the present disclosure employs the above-mentioned configuration to ensure that in performing the first operation or the third operation A, the refrigerant that has rejected heat in the first heat-source-side heat exchanger 81 or the second heat-source-side heat exchanger 82 passes through the first economizer heat exchanger 61 or the second economizer heat exchanger 62. As a result, sufficient heat exchange takes place in the economizer heat exchangers 61 and 62.

(4-3)

The air conditioner 1 according to the present disclosure performs a supercritical refrigeration cycle. In performing the supercritical refrigeration cycle, two-stage compression may be performed by using plural compressors. The two-stage compression may involve injecting cooled refrigerant to each compressor. In the air conditioner 1 according to the present disclosure, the first economizer heat exchanger 61 is connected in series with the first heat-source-side heat exchanger 81, and the second economizer heat exchanger 62 is connected in series with the second heat-source-side heat exchanger 82. Further, the common part 35 is disposed between the location of branching from the first main heat-source-side flow path 21, and the first economizer heat exchanger 61, and between the location of branching from the second main heat-source-side flow path 22, and the second economizer heat exchanger 62. This allows two-stage compression to be efficiently performed in the compressors 11 and 12 of the air conditioner 1 that performs a supercritical refrigeration cycle.

Further, the common part 35 is positioned as described above, and the common part 35 is provided with the expansion mechanism 36. This configuration allows for cost reduction compared to a configuration in which each of the first economizer pipe 31 and the second economizer pipe 32 individually has an expansion mechanism and individually returns to the compressors 11 and 12.

(5) Modifications

Reference is now made to modifications of the air conditioner 1 according to the above-described embodiments. Features similar to those in the embodiments mentioned above are denoted by like reference signs and not described in further detail below.

(5-1) Modification A

In the foregoing description of the embodiments, the compressors 11 and 12 are two compressors with a single-stage compression structure that are connected in series. However, the compressors according to the present disclosure may not necessarily have the above-mentioned configuration. Alternatively, for example, the compressors according to the present disclosure may have a two-stage compression structure such that the two compressors 11 and 12 are incorporated in a single casing.

(5-2) Modification B

Figure 10:
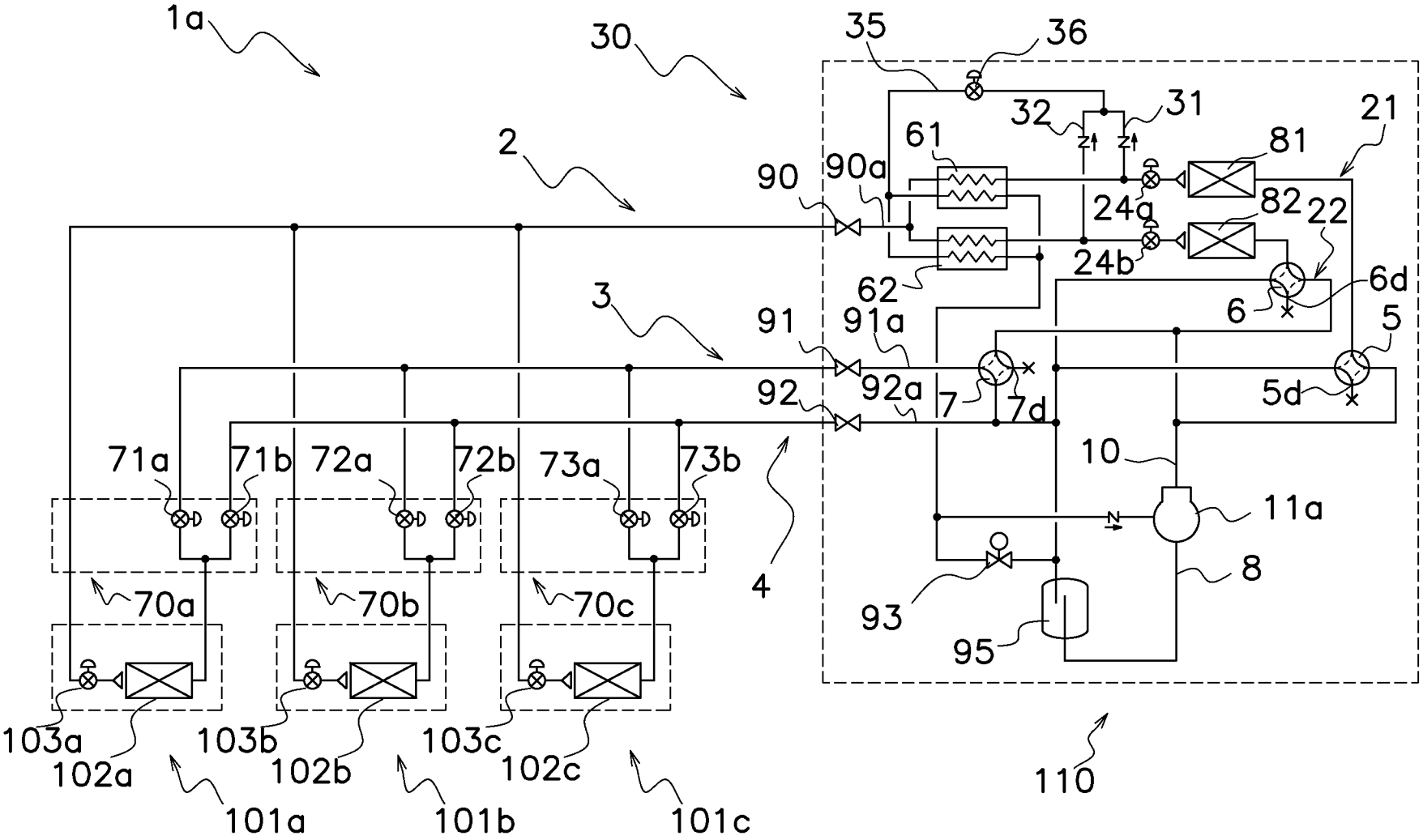
FIG. 10 is a schematic diagram of the air conditioner 1 according to a modification B.

In the foregoing description of the embodiments, the compressors 11 and 12 are two compressors with a single-stage compression structure that are connected in series. However, the compressors according to the present disclosure may not necessarily have the above-mentioned configuration. Alternatively, for example, a single compressor 11*a* with a single-stage compression structure may be used that has an injection port through which intermediate-pressure refrigerant can be introduced to some point in the compression process. When an air conditioner 1*a* employing this configuration is to perform a cooling only operation, a cooling main operation, or a cooling and heating simultaneous operation, the intermediate-pressure refrigerant in the refrigeration cycle flowing in the first economizer pipe 31 and the second economizer pipe 32 undergoes heat exchange in the first economizer heat exchanger 61 and the second economizer heat exchanger 62 before being routed via the injection port to the single compressor 11*a* with a single-stage compression structure (see FIG. 10).

(5-3) Modification C

In the foregoing description of the embodiments, the heat-source-side unit 110 includes two heat-source-side heat exchanger 81 and 82, and two economizer heat exchangers 61 and 62 respectively corresponding to the heat-source-side heat exchangers 81 and 82. However, the heat-source-side unit 110 according to the present disclosure may not necessarily include two heat-source-side heat exchangers and two economizer heat exchangers. Alternatively, the heat-source-side unit 110 may include a greater number of heat-source-side heat exchangers, and a number of economizer heat exchangers corresponding to the number of heat-source-side heat exchangers.

(5-4) Modification D

Figure 11:
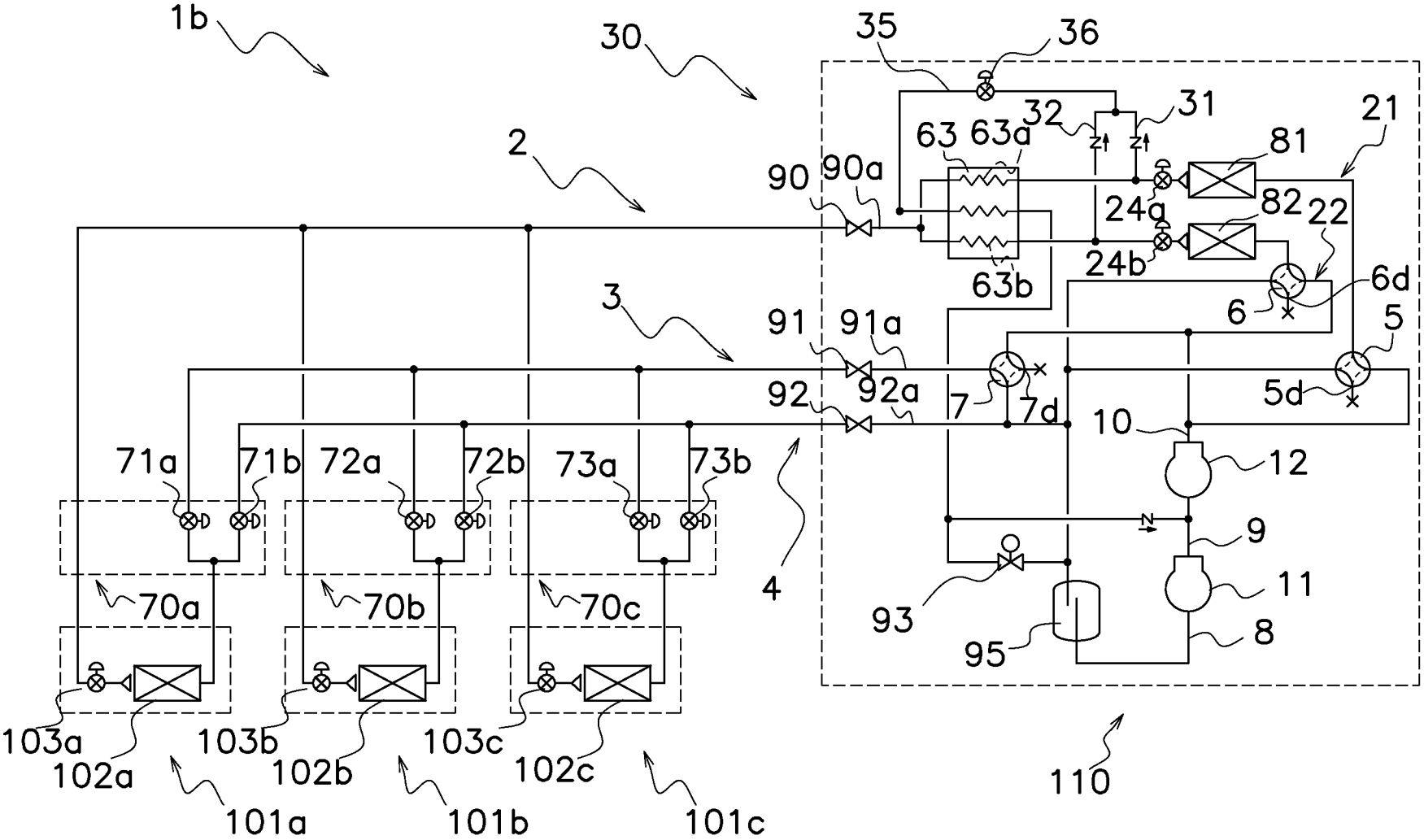
FIG. 11 is a schematic diagram of the air conditioner 1 according to a modification D.

In the foregoing description of the embodiments, the heat-source-side unit 110 of an air conditioner 1 includes two heat-source-side heat exchanger 81 and 82, and two economizer heat exchangers 61 and 62 respectively corresponding to the heat-source-side heat exchangers 81 and 82. However, the heat-source-side heat exchangers and the economizer heat exchangers according to the present disclosure may not necessarily be configured as described above. Alternatively, a single economizer heat exchanger 63 may have a number of high-pressure flow paths equal to the number of heat-source-side heat exchangers, and a single low-pressure flow path. For example, if the heat-source-side unit 110 includes two heat-source-side heat exchangers 81 and 82, the single economizer heat exchanger 63 has two high-pressure flow paths, and a single low-pressure flow path (see FIG. 11). In this case, the single economizer heat exchanger 63 serves as a first economizer heat exchanger 63*a* and a second economizer heat exchanger 63*b*. Further, in this case, the first economizer pipe 31 and the second economizer pipe 32 are merged in the common part 35, and the resulting merged economizer pipe returns to the compressors 11 and 12.

(5-5) Modification E

In the foregoing description of the embodiments, the first heat-source-side switching mechanism 5, the second heat-source-side switching mechanism 6, and the third heat-source-side switching mechanism 7 are four-way switching valves. However, according to the present disclosure, four-way switching valves may not necessarily be used as flow switching valves. For example, other switching valves, such as electromagnetic valves, electric valves, three-way valves, or five-way valves may be used as flow switching valves.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1, 1*a*, 1*b* air conditioner
2 liquid-refrigerant connection pipe
3 high/low pressure gas-refrigerant connection pipe
4 low pressure gas-refrigerant connection pipe
10 discharge pipe
11, 11*a*, 12 compressor
21 first main heat-source-side flow path
22 second main heat-source-side flow path
31 first economizer pipe
32 second economizer pipe
35 common part
36 expansion mechanism
61, 63*a* first economizer heat exchanger
62, 63*b* second economizer heat exchanger
70*a*, 70*b*, 70*c* branch unit
81 first heat-source-side heat exchanger
82 second heat-source-side heat exchanger
90 first shutoff valve
90*a* high pressure refrigerant pipe
91 second shutoff valve
91*a* high/low pressure pipe
92 third shutoff valve
92*a* low pressure refrigerant pipe
110 heat-source-side unit
101*a*, 101*b*, 101*c* use-side unit
120 control unit

PATENT LITERATURE

PTL 1: Japanese Unexamined Patent Application Publication No. 2010-156493

What is claimed is:

1. An air conditioner comprising:
use-side units that are each switchable between a cooling operation and a heating operation; and
a heat-source-side unit comprising:
a lower-stage compressor and a higher-stage compressor;
a discharge pipe to which a refrigerant is discharged after being compressed by the higher-stage compressor;
a first main heat-source-side flow path and a second main heat-source-side flow path that branch off from the discharge pipe;
a first heat-source-side heat exchanger;
a second heat-source-side heat exchanger;
a first economizer heat exchanger; and
a second economizer heat exchanger, wherein
the first heat-source-side heat exchanger is connected to the first economizer heat exchanger in series in the first main heat-source-side flow path,
the second heat-source-side heat exchanger is connected to the second economizer heat exchanger in series in the second main heat-source-side flow path,
the heat-source-side unit further comprises:
a first economizer pipe that branches off from the first main heat-source-side flow path and extends toward the lower-stage and higher-stage compressors; and
a second economizer pipe that branches off from the second main heat-source-side flow path and extends toward the lower-stage and higher-stage compressors,
the first economizer heat exchanger exchanges heat between the refrigerant flowing in the first main heat-source-side flow path and the refrigerant flowing in the first economizer pipe,
the second economizer heat exchanger exchanges heat between the refrigerant flowing in the second main heat-source-side flow path and the refrigerant flowing in the second economizer pipe,
the heat-source-side unit further comprises a common part,
the common part is disposed:
between the first main heat-source-side flow path and the first economizer heat exchanger in the first economizer pipe, and
between the second main heat-source-side flow path and the second economizer heat exchanger in the second economizer pipe, and
the common part comprises an expansion valve that is common to the first economizer pipe and the second economizer pipe.

2. The air conditioner according to claim 1, further comprising:
a controller that switches flows of the refrigerant in the heat-source-side unit among a first operation, a second operation, and a third operation, wherein in the first operation, the first heat-source-side heat exchanger and the second heat-source-side heat exchanger each function as a radiator, in the second operation, the first heat-source-side heat exchanger and the second heat-source-side heat exchanger each function as an evaporator, and in the third operation, the first heat-source-side heat exchanger functions as a radiator and the second heat-source-side heat exchanger functions as an evaporator.

3. The air conditioner according to claim 1, wherein the air conditioner performs a supercritical refrigeration cycle in which a pressure of the refrigerant discharged from the lower-stage and higher-stage compressors exceeds a critical pressure of the refrigerant.

4. The air conditioner according to claim 1, wherein the refrigerant comprises a CO2 refrigerant.

5. The air conditioner according to claim 1, wherein the heat-source-side unit further comprises:

a first shutoff valve at an end of a high pressure refrigerant pipe through which the refrigerant flows at a high pressure;

a second shutoff valve at an end of a high/low pressure pipe through which the refrigerant flows at a high or low pressure; and a third shutoff valve at an end of a low pressure refrigerant pipe through which the refrigerant flows at a low pressure, and the air conditioner further comprises:

a liquid-refrigerant connection pipe that connects the first shutoff valve and one of the use-side units;

a high/low pressure gas-refrigerant connection pipe that connects the second shutoff valve and one of the use-side units; and a low pressure gas-refrigerant connection pipe that connects the third shutoff valve and one of the use-side units.

* * * * *